US010750861B2

(12) United States Patent
Wohlgenannt

(10) Patent No.: US 10,750,861 B2
(45) **Date of Patent: *Aug. 25, 2020**

(54) DRIVE DEVICE FOR A MOVABLE FURNITURE PART

(71) Applicant: Julius Blum GmbH, Hoechst (AT)

(72) Inventor: Daniel Wohlgenannt, Bregenz (AT)

(73) Assignee: Julius Blum GmbH, Hoechst (AT)

( * ) Notice: Subject to any disclaimer, the term of this patent is extended or adjusted under 35 U.S.C. 154(b) by 79 days.

This patent is subject to a terminal disclaimer.

(21) Appl. No.: 15/862,176

(22) Filed: Jan. 4, 2018

(65) Prior Publication Data

US 2018/0160808 A1 Jun. 14, 2018

Related U.S. Application Data

(63) Continuation of application No. PCT/AT2016/050229, filed on Jun. 24, 2016.

(30) Foreign Application Priority Data

Jul. 7, 2015 (AT) ..... A 50592/2015

(51) Int. Cl.
*A47B 88/463* (2017.01)
*A47B 88/47* (2017.01)
(Continued)

(52) U.S. Cl.
CPC ..... *A47B 88/463* (2017.01); *A47B 88/45* (2017.01); *A47B 88/47* (2017.01); *E05C 19/022* (2013.01);
(Continued)

(58) Field of Classification Search
CPC ..... A47B 2088/4235; A47B 88/463; A47B 88/47; A47B 88/467; A47B 88/45;
(Continued)

(56) References Cited

U.S. PATENT DOCUMENTS 6,953,233 B2 10/2005 Lam et al.
8,534,781 B2 9/2013 Netzer et al.
(Continued)

FOREIGN PATENT DOCUMENTS

AT 512 699 10/2013
CN 102413733 4/2012
(Continued)

OTHER PUBLICATIONS

International Search Report dated Sep. 19, 2016 in International (PCT) Application No. PCT/AT2016/050229.
(Continued)

*Primary Examiner* — Daniel J Troy
*Assistant Examiner* — Timothy M Ayres
(74) *Attorney, Agent, or Firm* — Wenderoth, Lind & Ponack, L.L.P.

(57) ABSTRACT

A drive device for a movable furniture part includes a first lockable ejection device and a second lockable ejection device for ejecting the movable furniture part out of a closed position into an open position. The first ejection device has a first locking device and the second ejection device has a second locking device. The first locking device and the second locking device each have a locking position and an unlocking position. The first locking device and the second locking device are movable between the respective locking position and the respective unlocking position by rotational movement of a respective first component relative to a respective second component about a rotational axis oriented parallel to the longitudinal axis of the first ejection device and the second ejection device. A synchronizing device for synchronizing the first locking device and the second locking device.

17 Claims, 34 Drawing Sheets

(51) Int. Cl.

| | |
|---|---|
| ***A47B 88/45*** | (2017.01) |
| ***E05C 19/02*** | (2006.01) |
| ***E05C 19/06*** | (2006.01) |
| ***E05F 1/16*** | (2006.01) |
| *A47B 88/423* | (2017.01) |

(52) U.S. Cl.
CPC ..... *E05C 19/063* (2013.01); *E05F 1/16* (2013.01); *A47B 2088/4235* (2017.01); *E05Y 2900/20* (2013.01)

(58) Field of Classification Search
CPC . E05Y 2900/20; E05C 19/022; E05C 19/063; E05F 1/16
USPC ..... 312/333
See application file for complete search history.

(56) References Cited

U.S. PATENT DOCUMENTS

| | | | | |
|---|---|---|---|---|
| 9,375,083 | B2 | 6/2016 | Haemmerle et al. | |
| 9,386,851 | B2 * | 7/2016 | Dubach | A47B 88/47 |
| 9,532,648 | B2 | 1/2017 | Gasser et al. | |
| 9,622,578 | B2 | 4/2017 | Goetz et al. | |
| 9,775,434 | B2 * | 10/2017 | Flogaus | A47B 88/467 |
| 9,968,191 | B2 * | 5/2018 | Albrecht | A47B 88/45 |
| 10,143,303 | B2 * | 12/2018 | Koenig | E05F 1/16 |
| 10,251,481 | B2 * | 4/2019 | Goetz | E05F 1/16 |
| 2004/0000850 | A1 | 1/2004 | Lam Harn et al. | |
| 2009/0307869 | A1 * | 12/2009 | Salice | E05C 19/022 16/85 |
| 2010/0327719 | A1 * | 12/2010 | Koenig | E05C 19/022 312/333 |
| 2012/0038255 | A1 | 2/2012 | Netzer et al. | |
| 2013/0334946 | A1 | 12/2013 | Netzer et al. | |
| 2014/0265783 | A1 | 9/2014 | Hauer et al. | |
| 2014/0312627 | A1 * | 10/2014 | Frommann | E05B 83/34 292/57 |
| 2015/0091427 | A1 | 4/2015 | Haemmerle et al. | |
| 2015/0374123 | A1 | 12/2015 | Goetz et al. | |
| 2016/0007748 | A1 | 1/2016 | Gasser et al. | |
| 2016/0206093 | A1 | 7/2016 | Brunnmayr et al. | |
| 2017/0020285 | A1 | 1/2017 | Schallert et al. | |
| 2017/0051813 | A1 * | 2/2017 | Karu | E05F 1/16 |
| 2018/0020833 | A1 * | 1/2018 | Goetz | A47B 88/463 312/331 |
| 2018/0125235 | A1 * | 5/2018 | Wohlgenannt | A47B 88/47 |
| 2018/0160807 | A1 * | 6/2018 | Wohlgenannt | A47B 88/463 |
| 2018/0263369 | A1 * | 9/2018 | Chen | A47B 88/463 |

FOREIGN PATENT DOCUMENTS

| | | |
|---|---|---|
| CN | 103040254 | 4/2013 |
| DE | 20 2005 002 433 | 6/2005 |
| DE | 20 2008 013 230 | 4/2010 |
| DE | 20 2015 001 186 | 4/2015 |
| EP | 1 362 527 | 11/2003 |
| EP | 2 174 571 | 4/2012 |
| JP | 2015-506199 | 3/2015 |
| WO | 2010/129971 | 11/2010 |
| WO | 2014/008520 | 1/2014 |
| WO | 2014/165873 | 10/2014 |
| WO | 2014/165878 | 10/2014 |
| WO | 2015/051386 | 4/2015 |

OTHER PUBLICATIONS

Search Report dated Mar. 17, 2016 in Austrian Application No. A 50592/2015, with English translation.

* cited by examiner

St. d. T.

St.d T.

SS + VS

US + ES + B2

VS

SS

DRIVE DEVICE FOR A MOVABLE FURNITURE PART

BACKGROUND OF THE INVENTION

The present invention relates to a drive device. In addition, the invention relates to an item of furniture with such a drive device for a movable furniture part.

For many years there have been efforts in the industry of furniture fittings to incorporate as many movement functions of the movable furniture parts (e. g. drawers, furniture doors and furniture flaps) as possible into one drive device.

The non-generic WO 2015/051386 A2, for example, shows a drive device which comprises an ejection device arranged in a housing for ejecting the movable furniture part. Moreover, a retraction device is arranged in a separate housing. The ejection device comprises a locking device for locking the ejection device. The locking elements of the ejection device arranged on both sides of the movable furniture part can by synchronized by means of a synchronizing device. The locking, per se, is carried out by means of the latching element which engages in a cardioid-shaped sliding guide track. The latch element is arranged on a control lever which can be pivoted about a rotational axis oriented rectangular to the longitudinal axis. This pivoting movement leads to the necessity of a relative large construction space. In addition, there is a certain play because of the bearing of the control lever on the ejection slider, which play can adversely affect the gap—which is necessary for the over-pressing movement—between the drawer front and the furniture carcass.

In contrast, the generic AT 512 699 A1 shows a compactly built ejection device for a movable furniture part. Such a so-called TIP-ON device can be built in such a compact manner especially because the control element (corresponds to the locking pin) engaging the cardioid-shaped sliding guide track is rotating about a rotational axis oriented parallel to the longitudinal axis of the ejection device. It is disadvantageous with this generic drive device that no direct synchronization with an optionally present second ejection device is possible.

SUMMARY OF THE INVENTION

Thus, the object of the present invention is to provide an improved drive device compared to the prior art. In particular, the disadvantages of the prior art shall be resolved.

According to the invention, the drive device includes a further ejection device, and a synchronizing device for synchronizing the locking devices of the two ejection devices. Thereby, for the first time a drive device is provided where a relative small and thus space-saving ejection device can be synchronized with a furniture ejection device of that kind. By the synchronization, it is guaranteed that in the case of ejecting, the ejection device is certainly unlocked on both sides and that the movable furniture part does not reach an undesired slanted position.

Preferred embodiments of the present invention are described below.

Basically, it is possible that the locking device can be, for example mechanically or electronically, unlocked by a separate switch. Preferably, however, the locking device is movable from the locking position into the unlocking position by over-pressing the movable furniture part into an over-pressing position located behind the closed position.

For the construction of the locking device it is in principle possible that in the locking position the first component is in connection with the second component by a mechanical frictional engagement, whereby a movement of the first component into the unlocking position is prevented. Preferably, however, the first component can include a locking pin of the locking device and the second component can include a, preferably cardioid-shaped, locking guide track of the locking device. The locking pin engages the locking guide track and is guided and lockable in this locking guide track. For this purpose, preferably the ejection device can include an ejection force storage member, preferably held on an ejection housing, and an ejection slider force-actuated by the ejection force storage member. In particular, the locking pin of the locking device can be arranged on the ejection slider.

It is particularly preferable that the ejection device can include a housing. According to a preferred embodiment, the drive device can include a retraction device for retracting the movable furniture part from an open position into the closed position. The retraction device is arranged in the same housing as the ejection device.

In principle, the synchronizing device should be constructed in such a way that a connection in a movement transmission manner between the locking devices on the two sides of the ejection is possible through the housing of the two ejection devices. In particular, it is provided that the synchronizing device can include two synchronizing coupling pieces each associated to one ejection device, two synchronizing coupling counter pieces each associated to one ejection device and a synchronizing rod connecting the two synchronizing coupling counter pieces. It is particularly preferable that the synchronizing coupling pieces integrally form one part—preferably a locking element which integrally forms a latch recess—of the locking guide track, and in the case of an ejection movement of the ejection slider, a shifting movement of the synchronizing coupling piece can be converted into a rotational movement of the synchronizing rod after the over-pressing.

Further, an item of furniture can include a furniture carcass, a movable furniture part, and a drive device according to the invention.

BRIEF DESCRIPTION OF THE DRAWINGS

Further details and advantages of the present invention are described more fully hereinafter by the specific description made with reference to the examples illustrated in the drawings, in which.

DETAILED DESCRIPTION OF THE INVENTION

Figure 1:
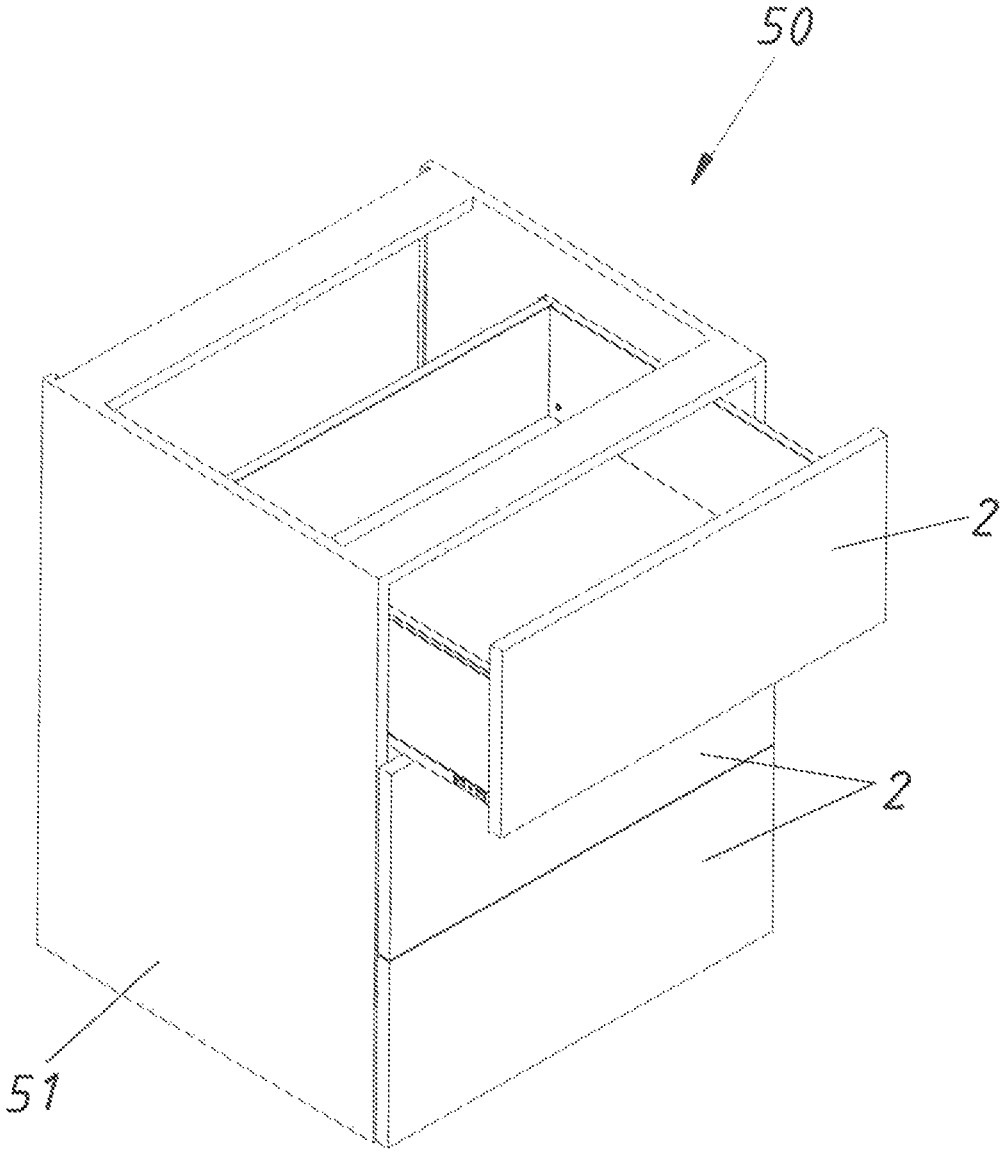
FIG. 1 is a perspective view of an item of furniture.

FIG. 1 shows in a perspective view, an item of furniture 50 with a furniture carcass 51 and three movable furniture parts 2 in form of drawers arranged above each other.

Figure 2:
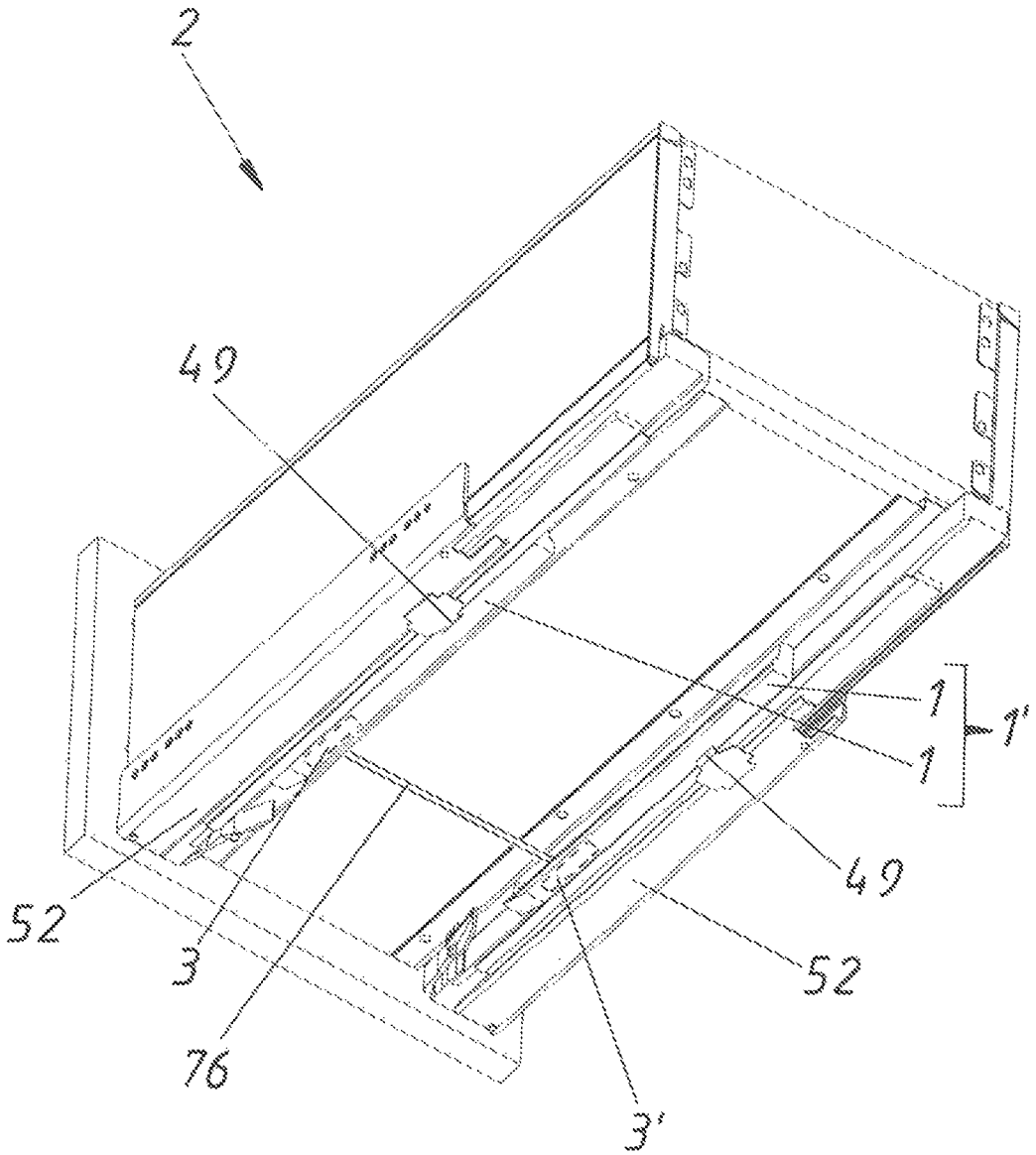
FIG. 2 is an angled view of the movable furniture from below.

FIG. 2 shows the movable furniture part 2 in an angled view from below. The extension guides 52 are illustrated on the two sides. A drive device 1 for a movable furniture part 2 is arranged on each extension guide 52, especially on each drawer rail 54 of the extension guide 52. When there is a synchronizing device 76 for the ejection devices 3 and 3', then the two drive devices 1—preferably formed mirror-symmetrical to each other—together form one common drive device 1'. On each bottom side of the carcass rail 53 of the two extension guides 52, a pin-formed entrainment member 49 is attached by means of a holding plate, which entrainment member 49 interacts with the corresponding drive device 1. In this case, each drive device 1 is associated to the movable furniture part 2 (in particular to the drawer rail 54), while the entrainment member 49 is fixed to the furniture carcass 51. Thus, the drive device 1 quasi repels from the fixed entrainment member 49. The described drive device 1 can also be used in an opposite manner, namely that the drive device 1 is mounted to the furniture carcass 51 or to the carcass rail 53 and acts onto the entrainment member 49—which then is associated to the movable furniture part 2. Thereby, the entrainment member 49—together with the movable furniture part 2 connected to the entrainment member 49—is ejected in opening direction OR by the drive device 1.

Figure 3:
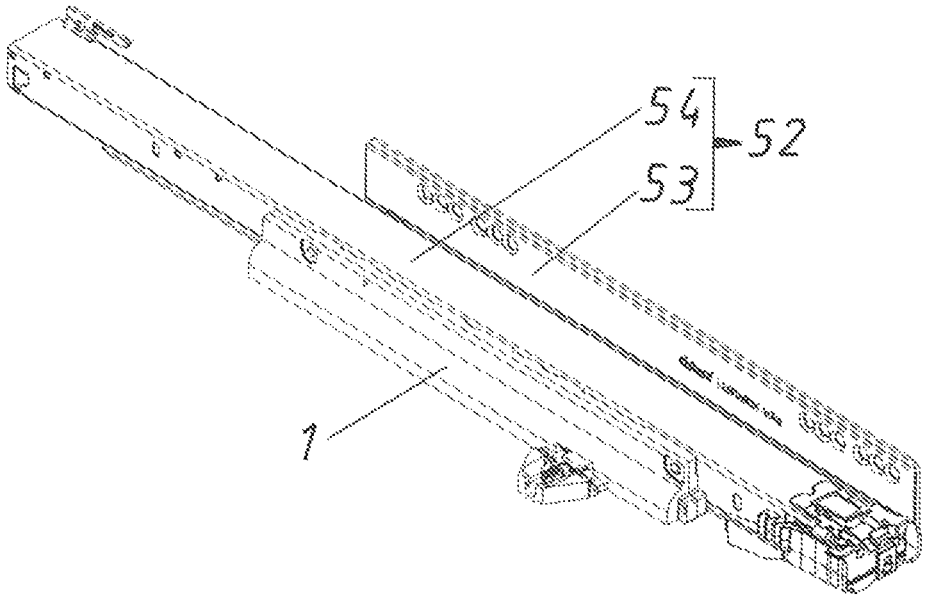
FIG. 3 perspectively shows an extension guide together with a drive device.

FIG. 3 illustrates, in a perspective view, the extension guide 2 including the carcass rail 53 and the drawer rail 54 together with the drive device 1 mounted to the drawer rail 54.

Figure 4A:
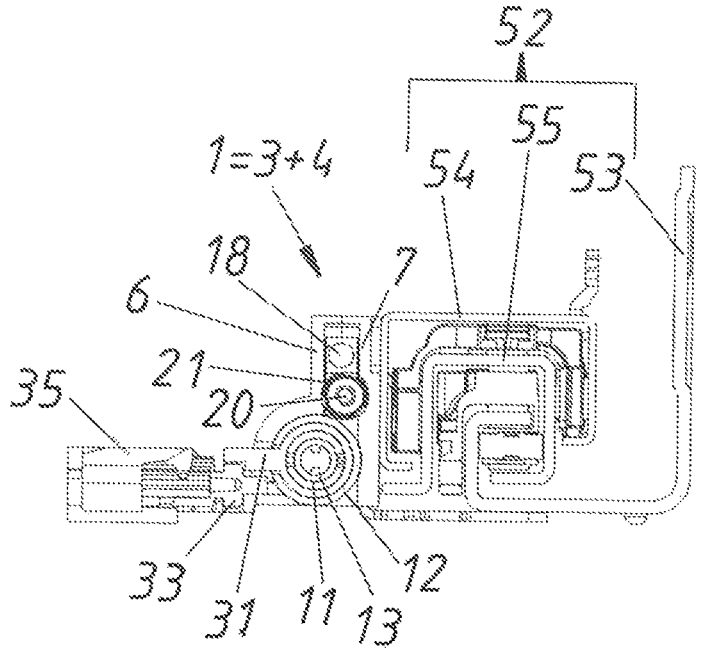
FIGS. 4*a* and 4*b* are a sectional view and a front view of FIG. 3, FIGS. 5*a* and 5*b* are a sectional view and a front view of a drive device according to the prior art.

FIG. 4*a* shows a sectional view through the drive device 1 and the extension guide 52 in the region of the synchronizing rod holder 35. It can be seen herein that the extension guide 52 for a full extension also comprises a central rail 55 besides the carcass rail 53 and the drawer rail 53. It is substantial that the ejection device 3 as well as the retraction device 4 is incorporated in a single housing, wherein this housing comprises the housing cover 6 and the housing base plate 7 (The remaining reference signs will be still explained in the later drawings.). In principle, the housing can also be formed in one piece. The single components do not have to be completely enclosed by the housing. Hence, the housing can clearly only be formed in the form of a base plate on which the components are held. Preferably, the housing is formed in two pieces and substantially completely encloses the single components. By this one housing, in which the ejection device 3 as well as the retraction device 4 is arranged, an easier and faster mounting of the drive device 1 is possible.

Figure 5A:
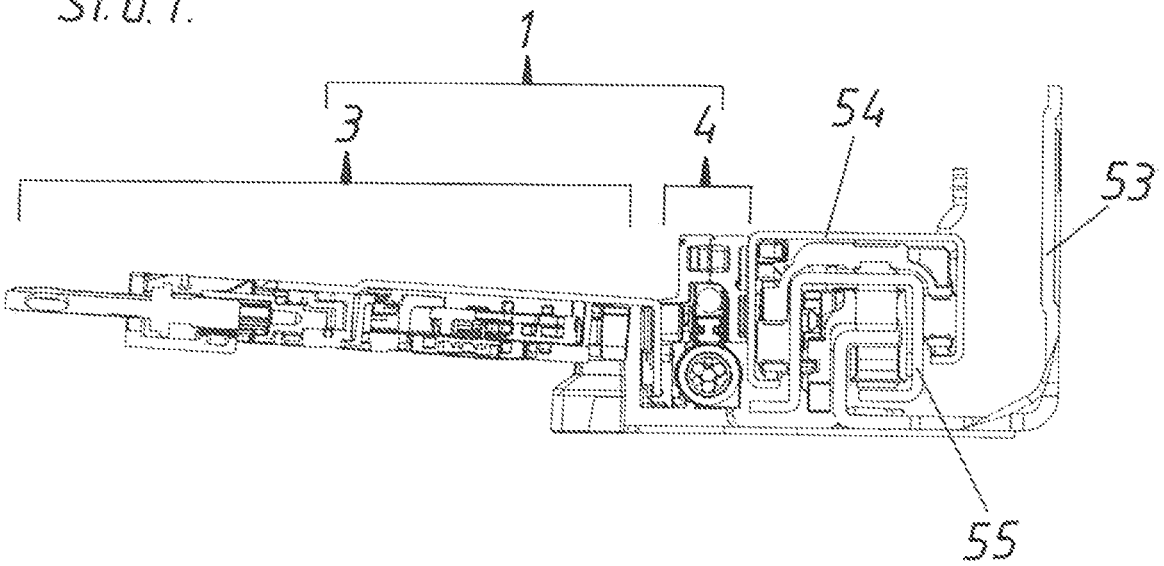

Conversely, FIG. 5*a* shows the prior art as currently produced and sold by the applicant. It can be seen at a first glance, that the two substantial components of the drive device 1—namely the ejection device 3 and also the retraction device 4—are formed and arranged separate from each other. This means, the retraction device 4 is mounted to the drawer rail 54 via a separate housing, while the ejection device 3 is attached to the retraction device 4 (or also to the not shown bottom side of the movable furniture part 2) also via a separate housing. A separate entrainment member (not shown here) has to be available for the ejection device 3 as well as for the retraction device 4.

Figure 4B:
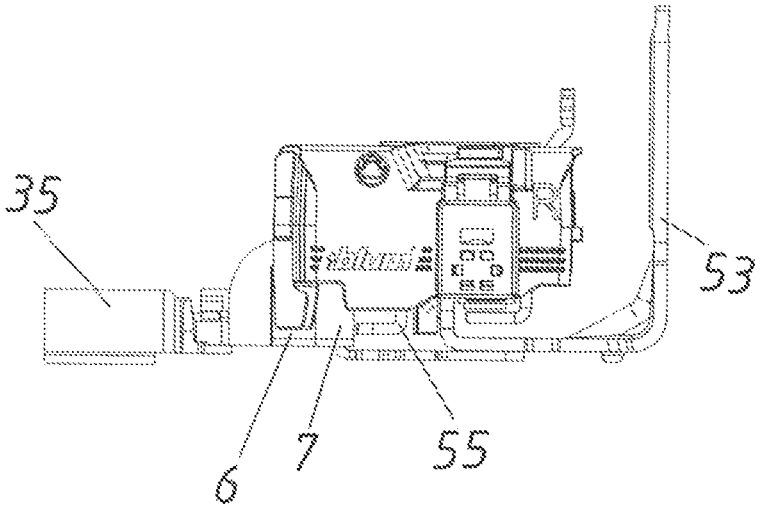
Figure 5B:
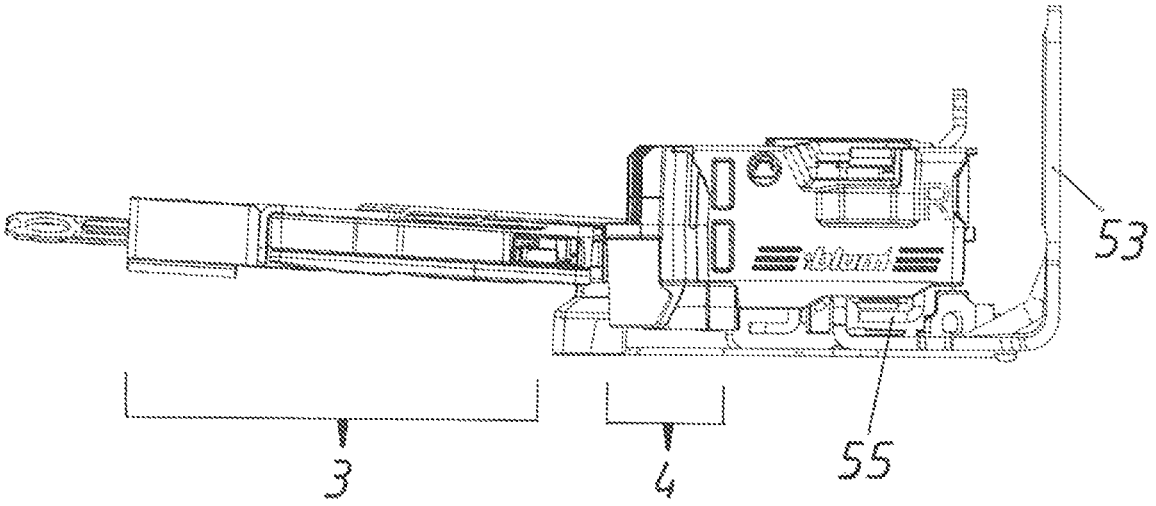

The FIGS. 4*b* and 5*b* each correspond to the previously mentioned FIGS. 4*a* and 5*a*, and both drawings show front views of the respective drive device.

Figure 6:
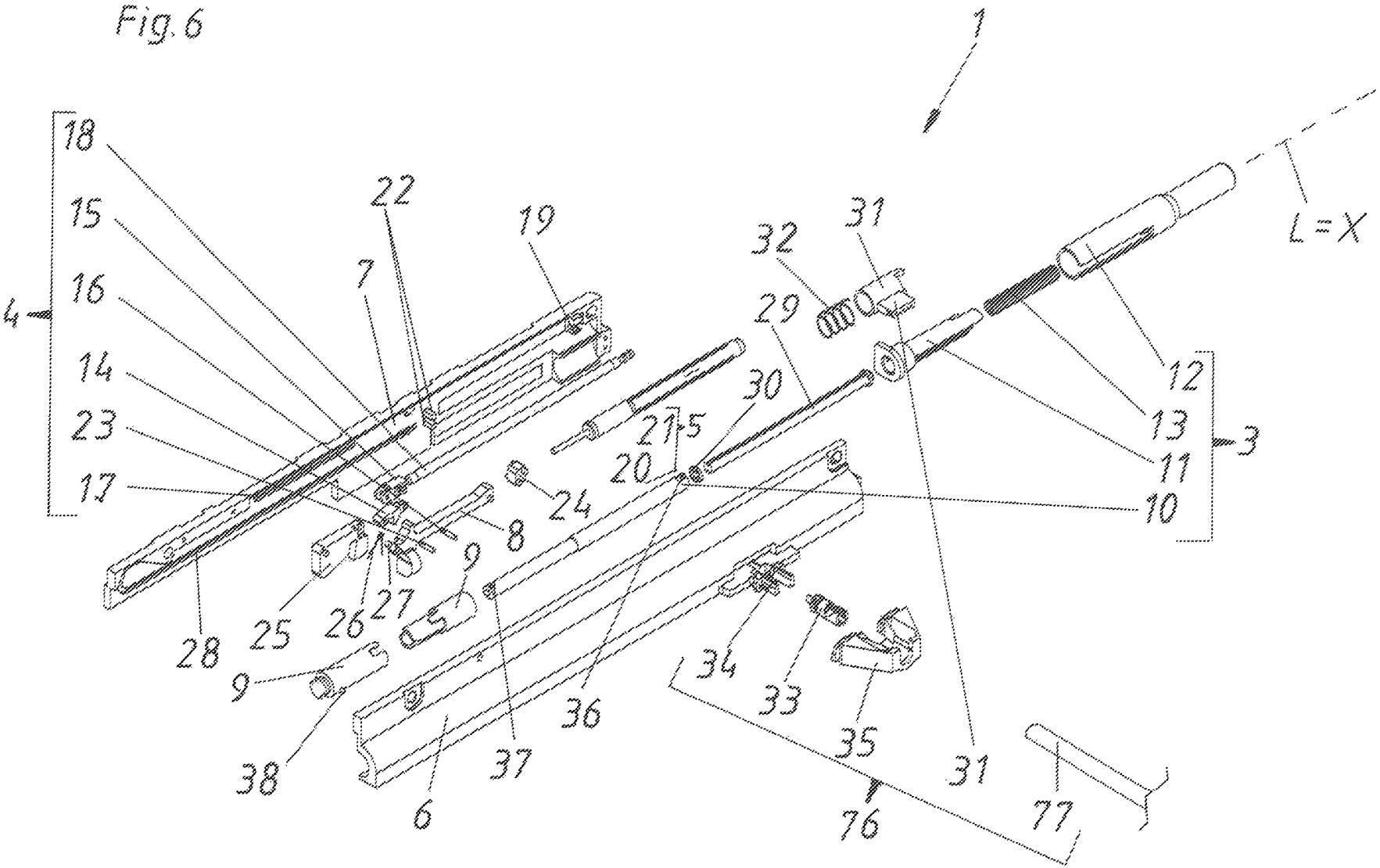
FIGS. 6 and 7 are exploded views of the drive device from different viewing angles.
Figure 7:
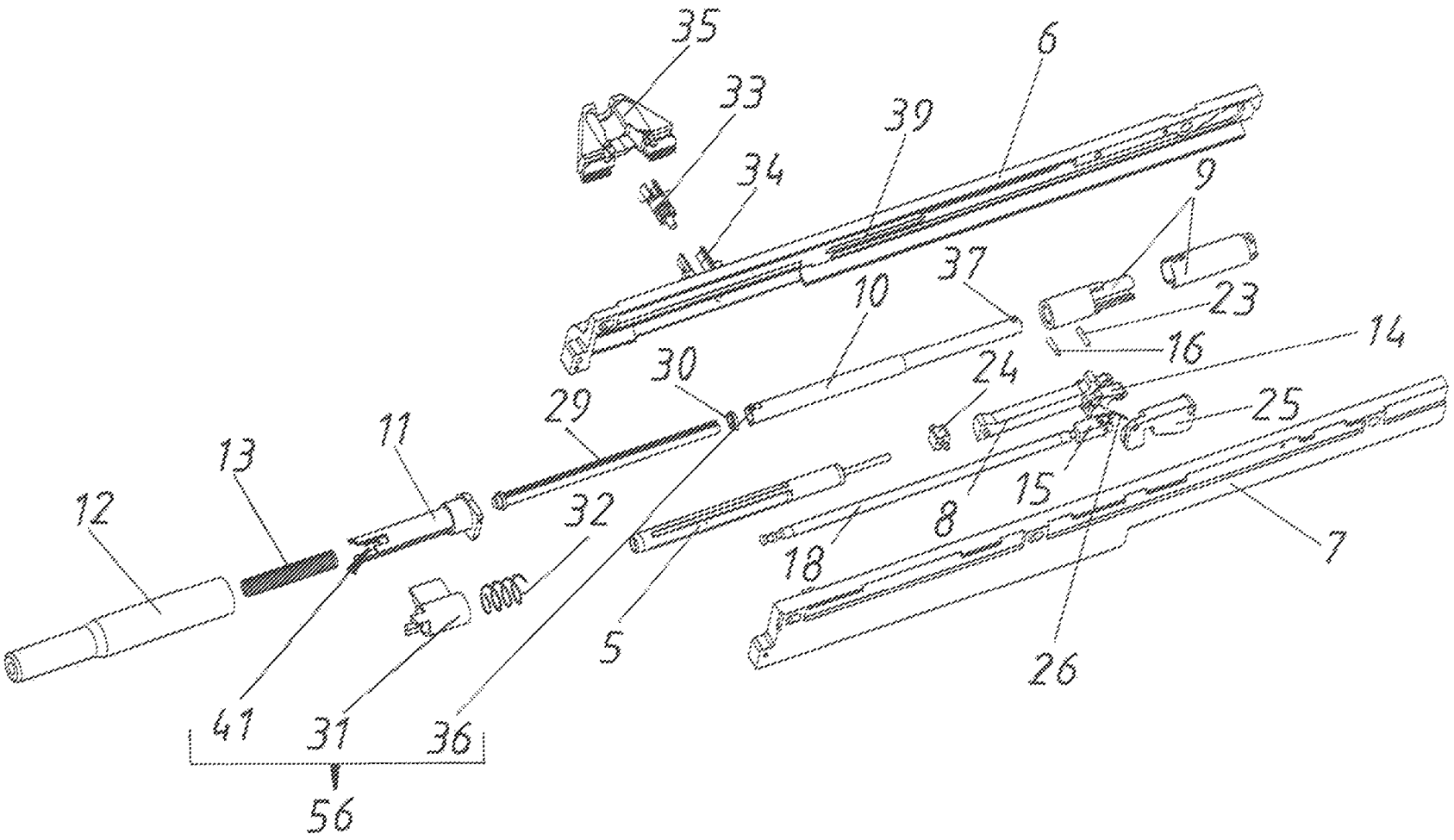

The substantial components of the drive device 1 are described below with reference to FIGS. 6 and 7. This drive device 1 includes the housing cover 6 and the housing base plate 7 as the two enclosing elements connected to each other. In principle, more components could of course form the housing, however, i for a simple production and a production with as little complexity as possible, there are only exactly two housing parts. The drive device 1 can be mounted to the drawer rail 54 by means of the housing base plate 7.

The two main components of the ejection device 3 (also referred to as TIP-ON mechanism or touch-latch-mechanism) are the ejection force storage member 23 as well as the ejection slider 10 which are movable along a longitudinal axis L. In this case, the ejection force storage member 13 is formed as a compression spring. Basically, this ejection force storage member 13 and also the ejection slider 10 could be directly attached to the housing or to a housing part. In this case, a separate ejection housing is provided which is designed in the form of an inner ejection housing 11 and an outer ejection housing 12. The two other components (ejection force storage member 13 and ejection slider 10) are at least partly guided in these ejection housing parts. A guiding bolt 29 is provided in order to maintain the positioning of the ejection force storage member 13 as exact as possible. Moreover, the separating element 30 is guided via a groove (in the guiding bolt 29) and a projection (on the separating element 30) on this guiding bolt 29. This separating element 30 in the form of a washer serves to prevent a direct torque transmission between the ejection force storage member 13 and the ejection slider 10 in the case of a rotation of the ejection slider 10 about the rotational axis X oriented parallel to the longitudinal axis L and because of the torsion of the ejection force storage member 13. A locking pin 36 is arranged on the end of the ejection slider 10 facing the ejection force storage member 13. This locking pin 36, together with the cardioid-shaped locking guide track 41 formed in the ejection housing 11, 12, and together with a locking element 58 integrally formed with the synchronizing coupling piece 31 (see FIG. 9), forms a locking device 56 for the ejection device 3.

For the basic function it would be sufficient if the locking guide track 41 would be stationarily formed in this ejection housing 11, 12. A synchronizing coupling piece 31 is provided for a simple synchronization with the second drive device 1 arranged on the other side of the movable furniture part 2. This synchronizing coupling piece 31 is movable in longitudinal direction L relative to the ejection housing 11, 12. This synchronizing coupling piece is actuated by the synchronizing force storage member 32 (in this case a compression spring). This synchronizing piece 31 can be connected to the synchronizing coupling counter piece 33 in a movement transmitting manner. The synchronizing coupling counter piece 33 is movably, preferably rotationally, supported in the synchronizing guide 34 of the housing. Concretely, a gear rack is formed on the synchronizing coupling piece 31 which meshes with a gear wheel formed on the synchronizing coupling counter piece 33. A synchronizing rod 77 can be attached to the synchronizing coupling counter piece 33. A synchronizing rod holder 35 is provided for a secure mounting. For the functional principle of this whole synchronizing device, it can be exemplarily referred to WO 2015/051386 A1.

Further, the drive device 1 includes a retraction device 4. The substantial parts of this retraction device 4 are the retraction force storage member 18, the retraction slider 15, the retraction latch 14 and the retraction locking track 17. The retraction force storage member 18 is on the one side attached to the ejection force storage member base 19 of the housing base plate 7, and on the other hand attached to the retraction slider 15. In principle, the retraction slider 15 can be directly lockable in an angled end section of the retraction locking track 17. In this case, however, it is provided that the retraction latch 15 is pivotally supported on the retraction slider 15 by means of the retraction connecting pin 16, and the whole retraction slider 15 is lockable in a retraction locking position in an angled end section of the retraction locking track 17 by means of a retraction locking pin 23 attached to the retraction latch 14. The retraction force storage member 18 is formed as a tension spring which moves the retraction slider 15 to the right according to the illustration in FIG. 6 when relaxing.

This retraction movement, per se, can be carried out only by the force of the retraction force storage member 18. However, in order to enable a soft retracting, the drive device 1 also comprises a damping device 5 for the retraction device 4. For that purpose, the damping device 5 includes a damping cylinder 21 and a damping piston 20 guided in the damping cylinder 21. The damping cylinder 21 is held between the housing cover 6 and housing base plate 7. The damping piston 20 is guided by the damping piston guide 22. During its movement path, this damping piston 20 partially acts onto the intermediate piece 24. This intermediate piece 24 is movably supported in a limited manner in the intermediate piece guide track 39 via corresponding guiding projections.

The drive device 1 further includes a push element 8 and a coupling element 9 in order to enable that the retraction device 4 as well as the ejection device 3 can be incorporated in a single housing 7, 6. The coupling element 9 is shown in two pieces in the illustrations according to FIGS. 6 and 7. This, however, is only advantageous because of manufacturing reasons. Otherwise, this coupling element 9 can also be formed in one piece. The push element 8, in turn, is slidably supported in the guide track 28 via corresponding projections. Also the catch hook 25 is guided in the guide track 28. Moreover, the catch hook 25 is rotatably supported on the push element 8 by means of the catch hook rotary bearing 27. Further, the catch hook force storage member 26 (in the form of a leg spring) is arranged between the catch hook 25 and the push element 28. The catch hook force storage member 26 guarantees a secure locking of the catch hook 25 in the angled end section of the guide track 28. For a compact construction it is provided that the housing 6, 7 of the drive device 1, the coupling element 9 and the ejection slider 10 (carrier) are at least partly formed sleeve-shaped or cylindrical. In particular, the ejection housing 11, 12 together with the locking guide track 41 formed therein, the coupling element 9 together with the coupling track 45 formed therein and the housing 6, 7 together with the control track 40 formed therein are cylindrically formed. The locking guide track 41, the coupling track 45 and the control track 40 each are formed on a, preferably inward facing, cylinder jacket surface vaulted about the rotational axis X.

Figure 8:
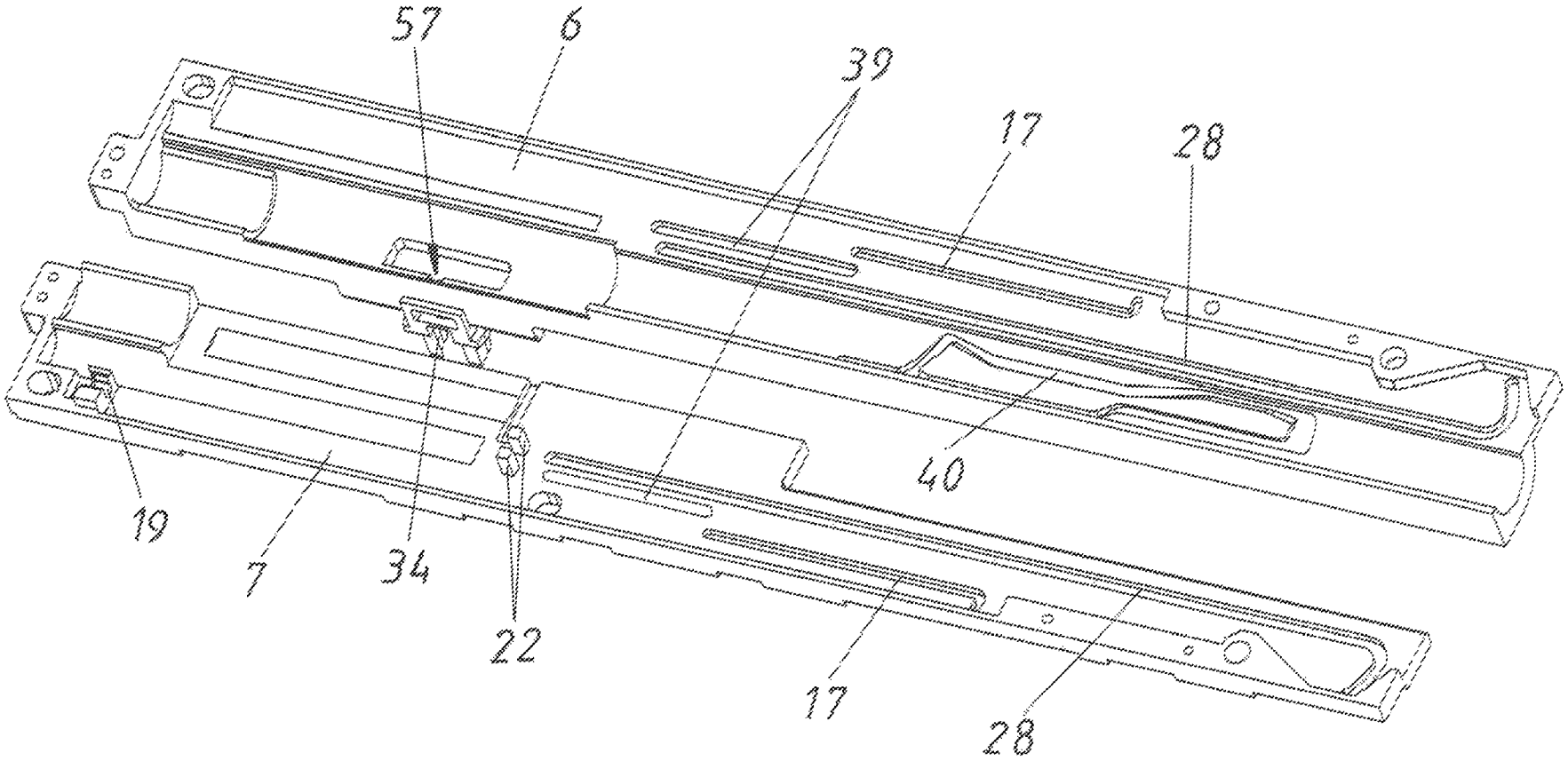
FIG. 8 shows the two housing part of the drive device with internal details.

FIG. 8 shows the housing cover 6 and the housing base plate 7 in an unfolded state so that the details formed therein are better visible. The retraction locking guide tracks 17 for the retraction latch 14, the guide tracks 28 for the catch hook 25 and the push element 8 as well as the intermediate piece guide track 39 are each mirror-symmetrically formed in the two housing parts 6 and 7. In contrast, the retraction force storage member base 19 and the damping piston guide 22 are formed in or on the housing base plate 7. Moreover, the synchronizing guide 34 as well as the opening 57 can be seen on or in the housing cover 6. The synchronizing coupling piece 34 projects from the housing through this opening 57.

Figure 9:
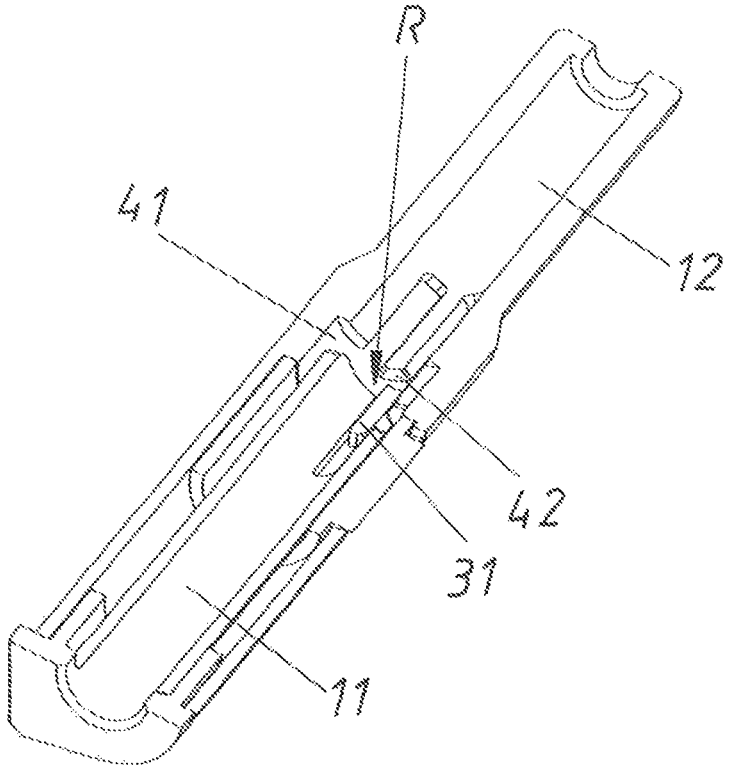
FIGS. 9 to 11 show the ejection housing and the synchronizing counter piece in different positions and different viewing angles.
Figure 9:
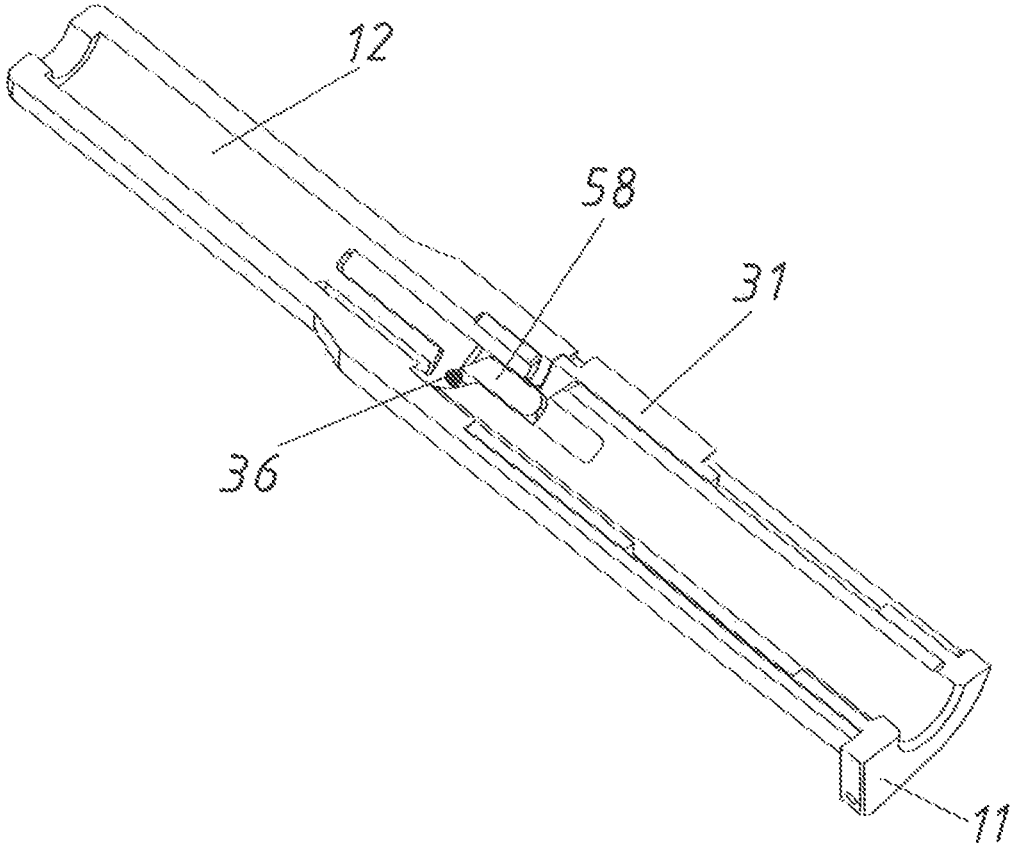

FIG. 9, in two different perspectives, shows an insight of an ejection housing 11, 12 cut in half. It can be determined that parts of the locking guide track 41 for the locking pin 36 are formed in the inner ejection housing 11 as well as in the outer ejection housing 12. In addition, the latch recess R is partly formed by the inner ejection housing 11 and partly formed by the locking element 58. The locking pin 36 is schematically shown in the lower illustration of FIG. 9 when this locking pin 36 is locked in the latch recess R.

Figure 10:
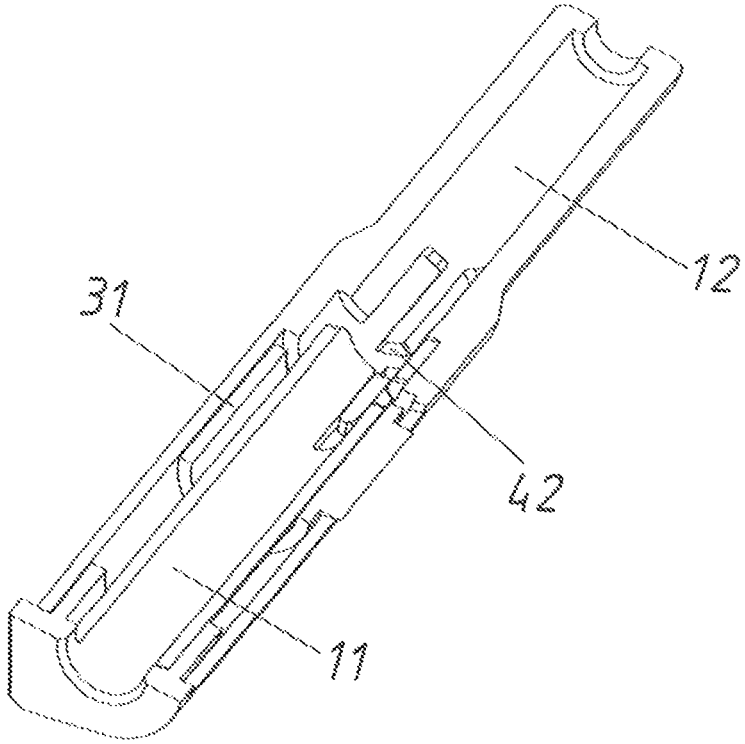
Figure 10:
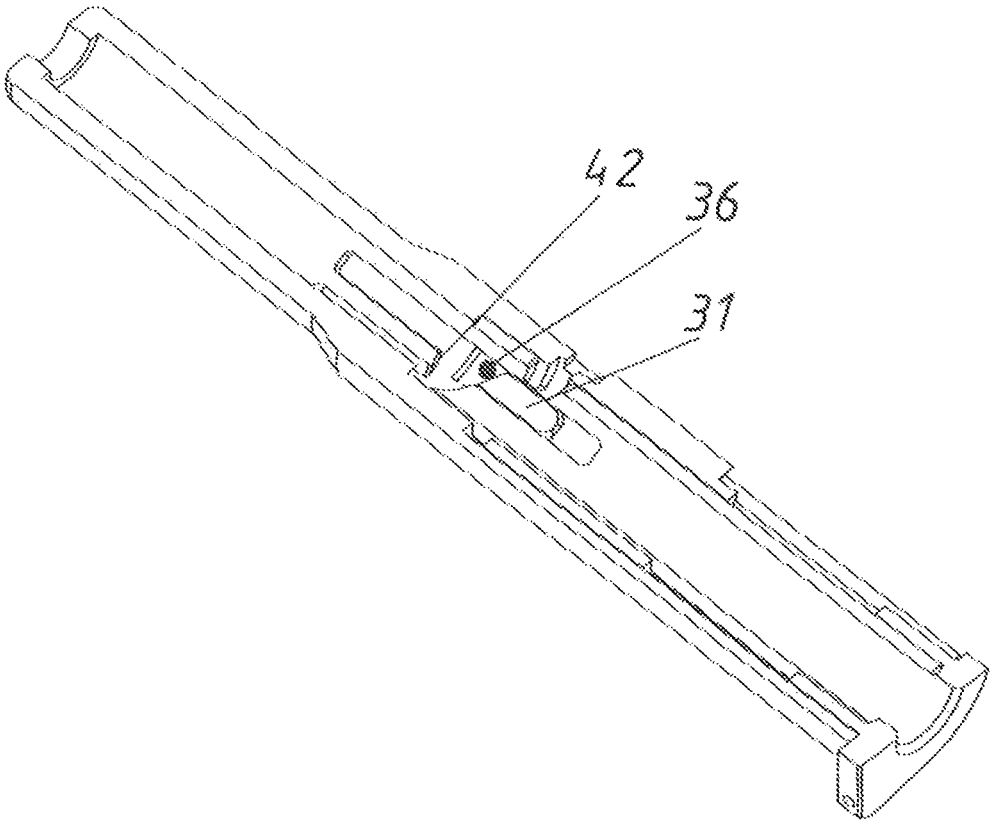

In the case of an unlocking of the locking device 56 by over-pressing the movable furniture part 2 in closing direction SR, the locking pin 36 is moved in the direction of the deflection slope 42 and is deflected by this deflection slope 42 so that the locking pin 36 reaches an ejection section of the locking guide track 41. After releasing the movable furniture part 2, the locking pin 36 contacts the locking element 58 on a front side (see FIG. 10), and the force of the ejection force storage member 13 ejects the ejection slider 10 together with the locking pin 36 attached thereon in opening direction OR.

Figure 11:
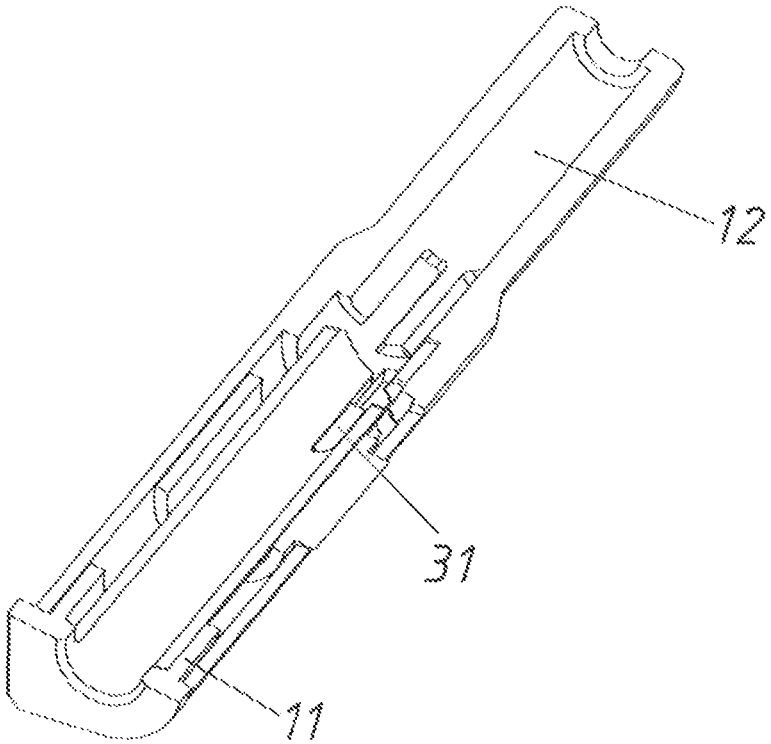
Figure 11:
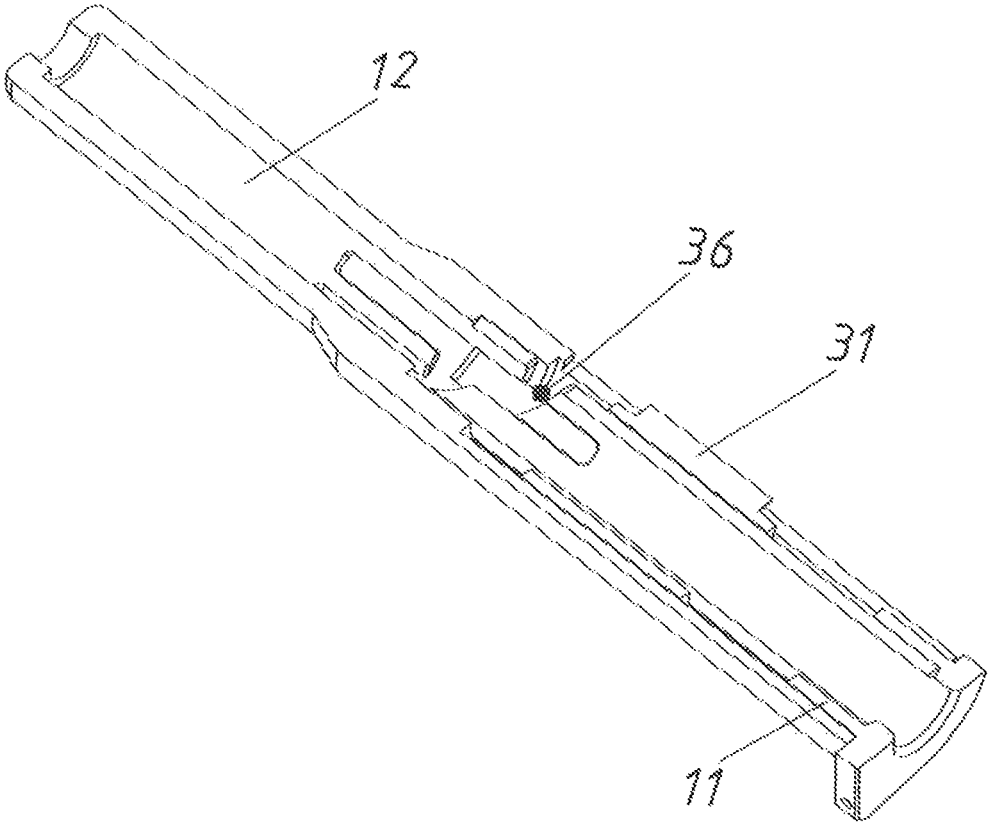

Subsequently, the locking element 58—which is integrally formed with the synchronizing coupling piece 31—is further moved in opening direction OR until the position according to FIG. 11 is reached. In this position the locking pin 36 is just deflected again by an inclined surface in the ejection section of the locking guide track 41 (see lower illustration of FIG. 11).

Figure 12:
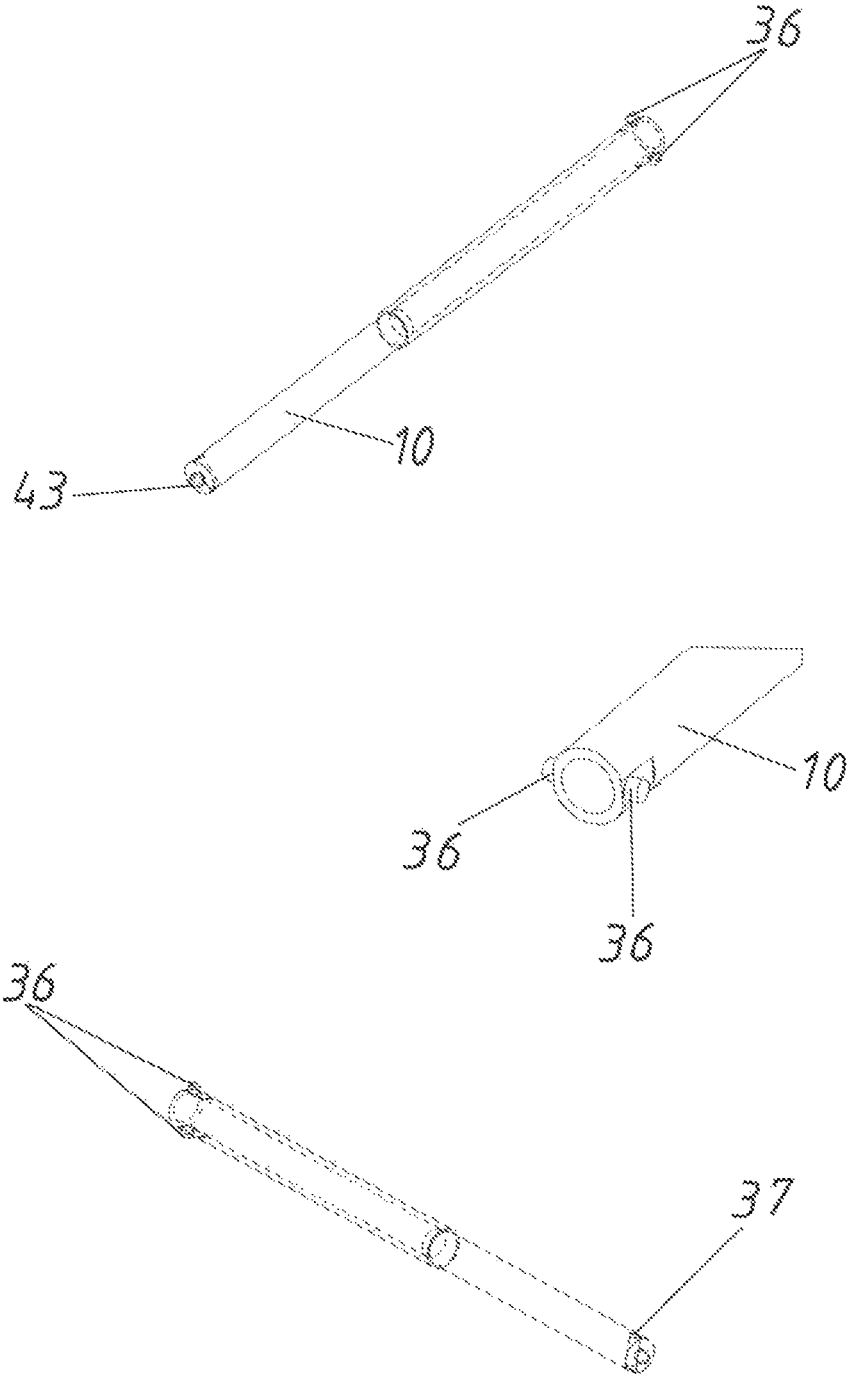
FIG. 12 is a detailed view of the ejection slider.
Figure 13A:
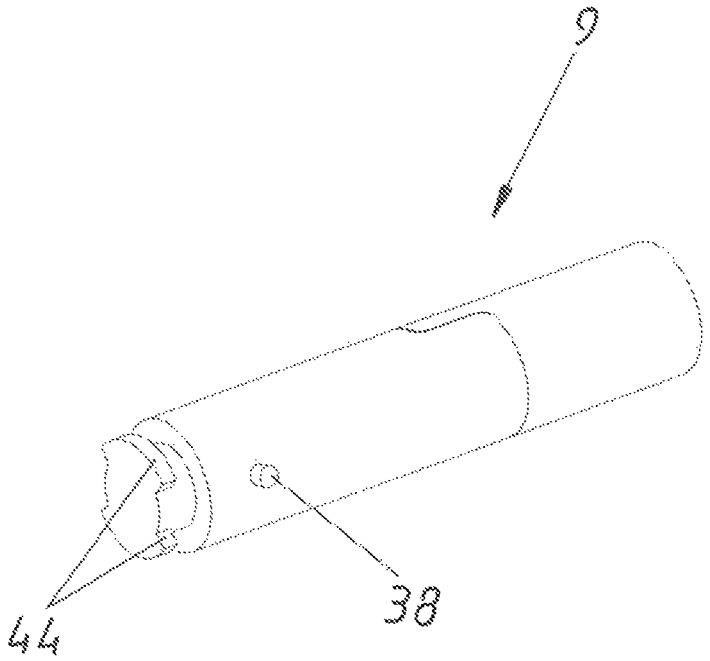
FIGS. 13*a* to 13*d* are different views and section of the coupling element.
Figure 13B:
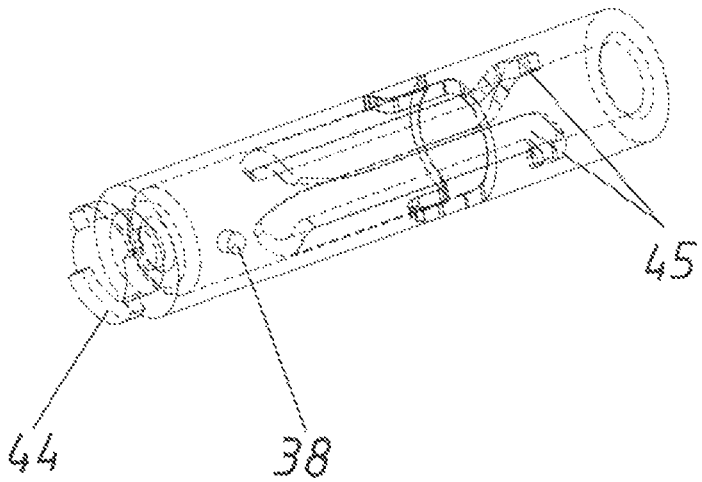
Figure 13C:
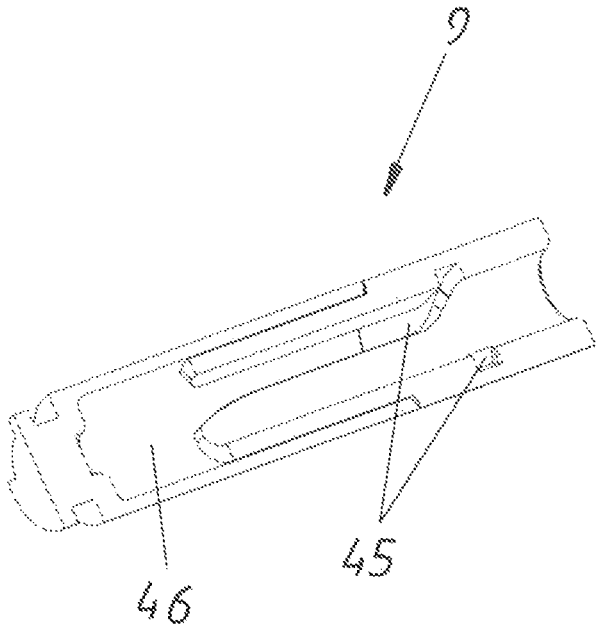
Figure 13D:
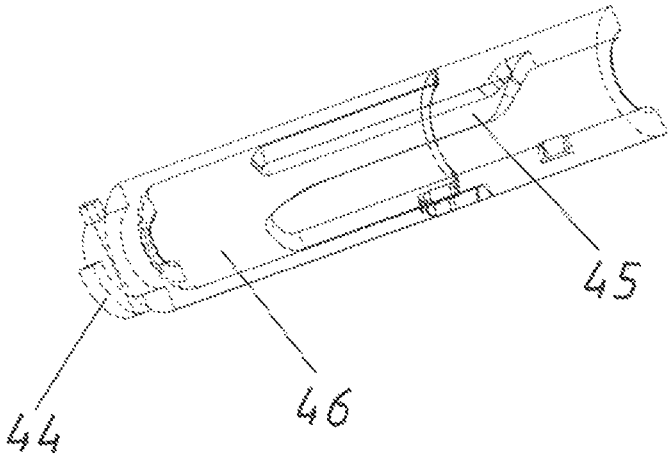

FIG. 12 illustrates in different views that the ejection slider 10 comprises two opposite locking pins 36 on its end directed towards the ejection force storage member 13. A hemisphere-shaped abutment 43 is provided on the end remote from the ejection force storage member 13. This abutment 43 serves for minimizing the torque between the touching parts (ejection slider 10 and coupling element 9). On this end, moreover, a recess is provided in which a coupling pin 37 (not shown here) can be attached.

FIGS. 13*a* to 13*d* still show different, partly cut or partly transparent views of the sleeve-shaped coupling element 9. The control pin 38 is formed on the coupling element 9. In addition, the bayonet-like coupling parts 44 are provided on a top end. In the interior of these coupling elements 9—this means on the inward cylinder jacket surface—two identical coupling tracks 45 are formed. The coupling tracks 45 are shifted to each other by 180°. These coupling tracks 45 comprise a continuous freewheel section 46 for the coupling pin 37 arranged on the ejection slider 10.

Figure 14:
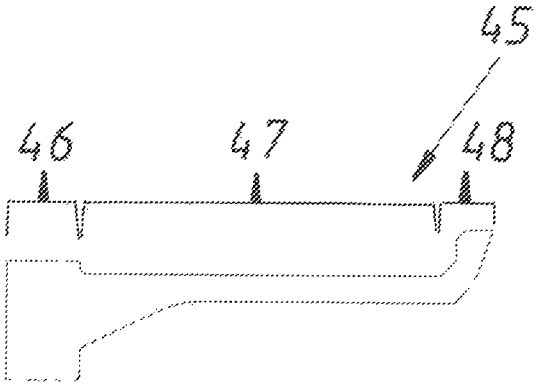
FIG. 14 shows the coupling track projected onto a straight surface.

Such a coupling track 45 is illustrated in FIG. 14. This coupling track 45 comprises the three sections freewheel section 46, guiding and idling section 47 as well as holding section 48. The coupling pin 37 is movable in this coupling track 45.

Figure 15:
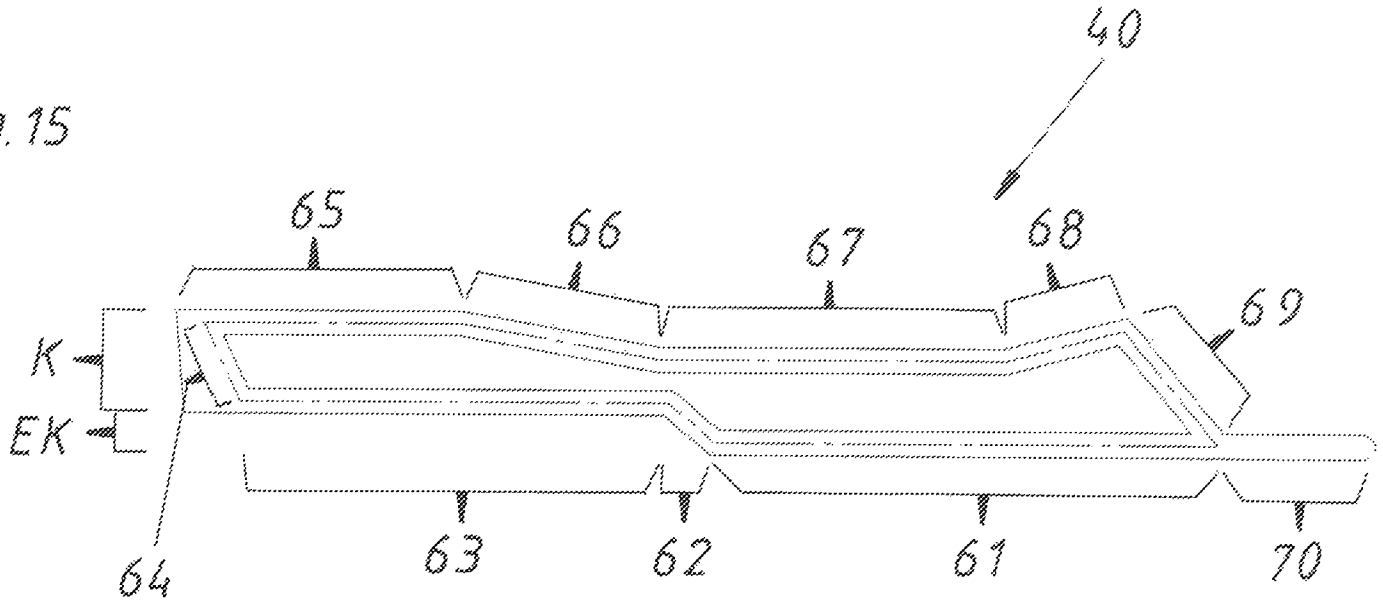
FIG. 15 shows the control track projected onto a straight surface.

In contrast, FIG. 15 shows the control track 40 formed on a cylinder-jacket-shaped inner side of the housing cover 6 projected onto a flat surface. The control pin 38 arranged on the coupling element 9 moves in this control track 40. Depending on the position of the control pin 38 in the control track 40, the coupling element 9 is coupled by means of the bayonet-like coupling parts 44 with the push element 8 (coupling region K) or uncoupled (uncoupling region EK). In addition, also the relative movements of the coupling element 9 and the ejection slider 10 to each other about the rotational axis X oriented parallel to the longitudinal direction L is controlled by this control track 40. These entire control movements are demonstrated in the movement sequence of the whole drive device 1 illustrated and explained in more details in the following FIGS. 16 to 31.

Figure 16:
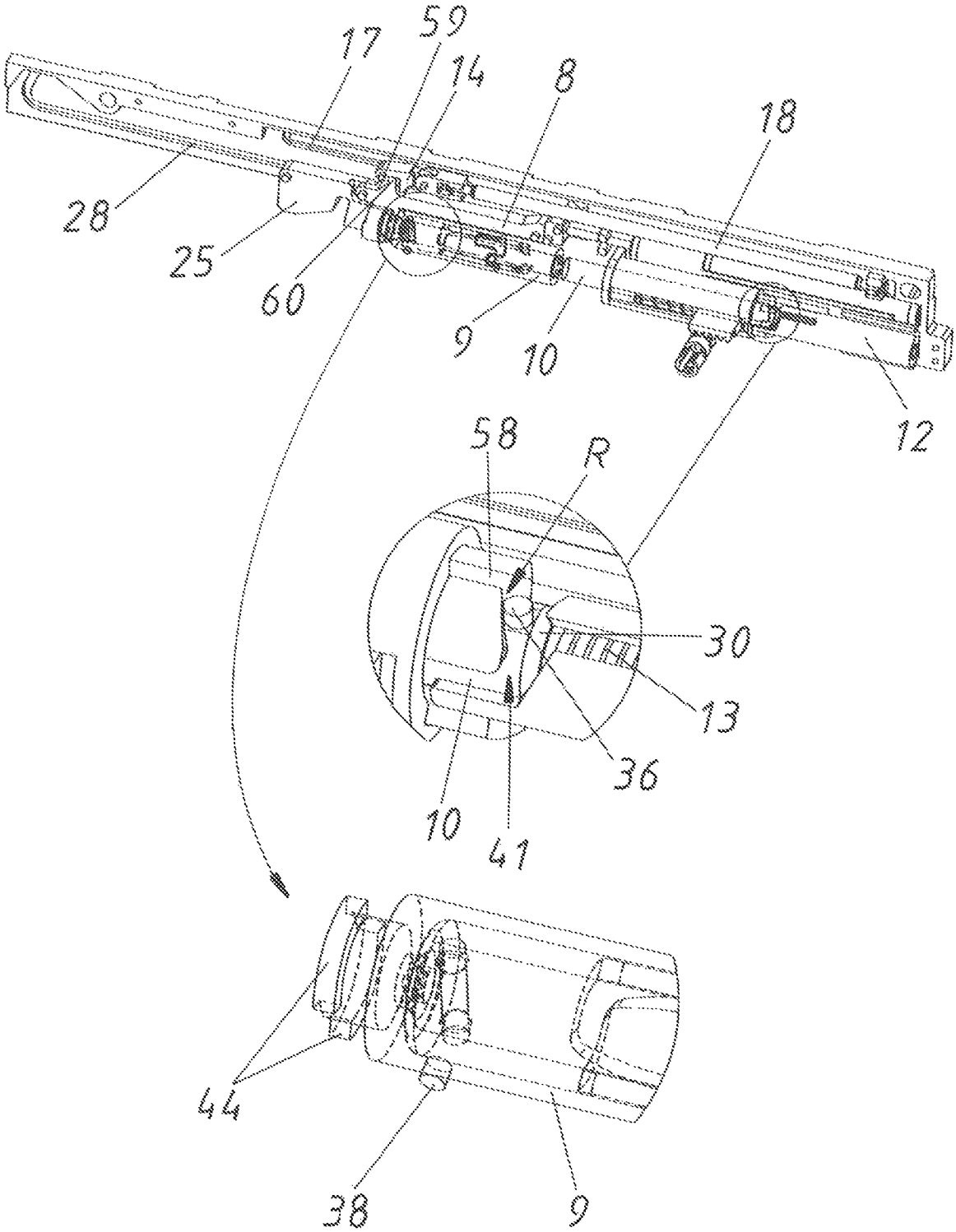
FIGS. 16 to 31 show different positions of the movement sequence of the drive device with several details and FIGS. 32 to 34 are views and details of exceptional positions.

Referring to FIG. 16, it shall initially be noted that the drive device 1 is illustrated in an assembled state without the housing cover 6. Moreover, the single components are illustrated partially transparent (see dashed line). In FIG. 16 the movable furniture part 2 is in a closed position SS. In addition, the locking device 56 is in a locking position VS as the locking pin 36 (see the upper detail) is locked in the latch recess R of the locking guide track 41. The ejection force storage member 13 presses via the separating element 30 onto the locking pin 36 arranged on the ejection slider 10, so that the locking pin 36 cannot be moved relative to the inner ejection housing 11 (which in fact is fixedly connected to the housing 6, 7). The locking element 58 formed by the synchronizing coupling piece 31 is jointly forming the latch recess R of the locking guide track 41. In the lower detail of FIG. 16, moreover, the end region of the coupling element 9 with the bayonet-like coupling parts 44 is illustrated. In the closed position SS the coupling element 9 is not coupled to the push element 8. Further, FIG. 15 shows that the retraction force storage member 18 is not tensioned. The retraction latch 14 contacts the push nose 60 of the push element 8 with its catch section 59.

Figure 17:
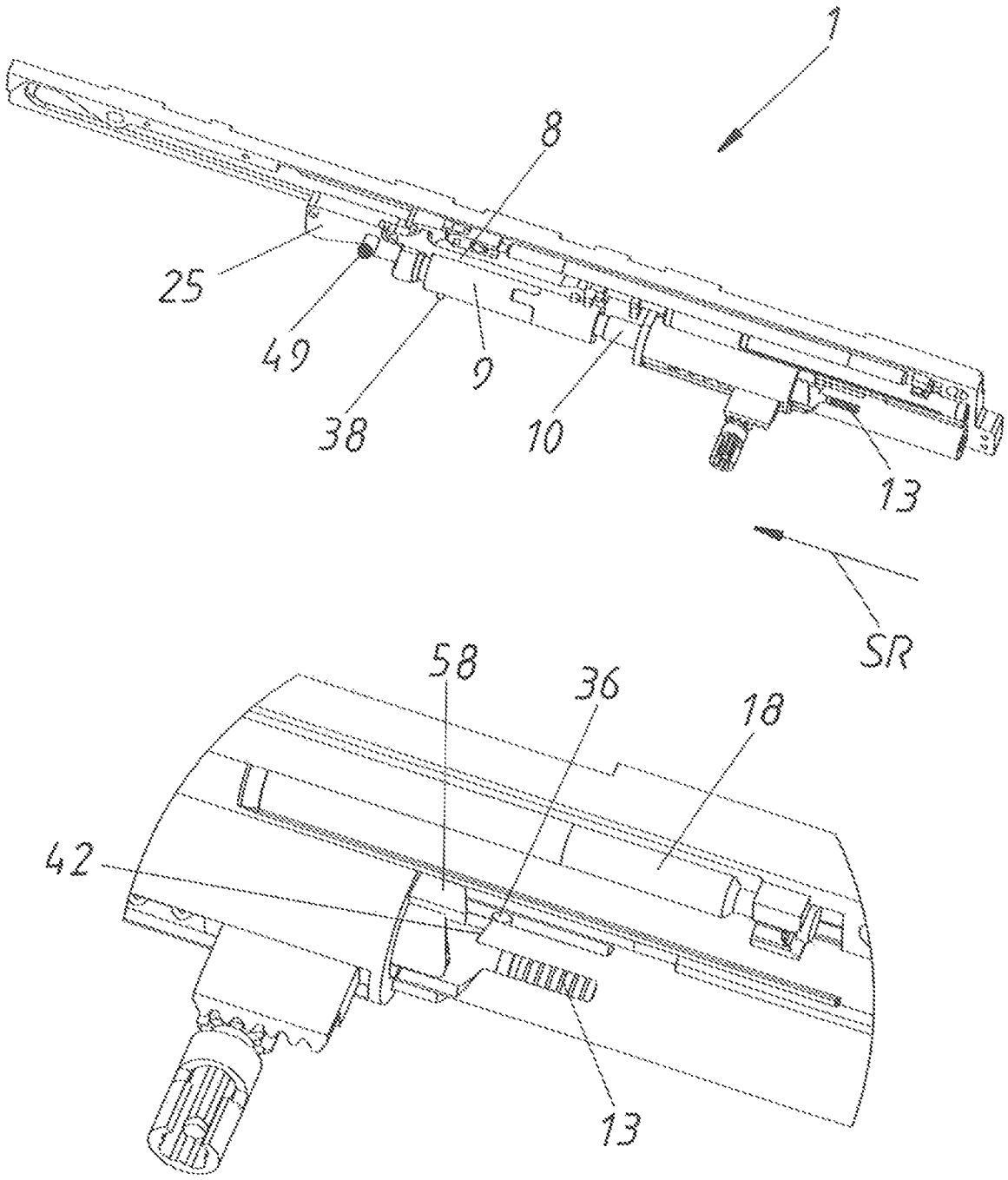

If now pressing in closing direction SR onto the movable furniture part 2, starting from the closed position SS according to FIG. 16, the unlocking is carried out as illustrated in FIG. 17. Thereby, the second operating mode B2 of the drive device 1 is initiated. As in the preferred embodiment the drive device 1 is arranged on the movable furniture part 2, the housing 6, 7 of the drive device 1 is moved in closing direction SR (in FIG. 17 to the left). As, however, the catch hook 25 is abuts the schematically illustrated entrainment member 49 fixed to the furniture carcass 51, the ejection slider 10 abutting the coupling element 9 is moved—by means of the catch hook 25, by means of the push element 8 connected to the catch hook 25 and by means of the coupling element 9 abutting the push element 8—relative to the remaining components of the drive device 1 against the force of the ejection force storage member 13 until the locking pin 36 abuts the deflection slope 42 of the locking guide track 41 and via this deflection slope 42 reaches the position according to FIG. 17 in the ejection section of the locking guide track 41. Thereby, the locking device 56 is no longer in the locking position 56 but is rather unlocked (unlocking position ES). The over-pressing path is about 1 to 3 mm. If the housing 6, 7 is not arranged on the movable furniture part 2 but rather on the furniture carcass 51, in principle the same relative movement between the single components of the drive device 1 is carried out when over-pressing. In that case, however,—in contrast to the arrow SR in FIG. 17—the ejection slider 10 is moved to the right in the closing direction SR by the moved entrainment member 49 arranged on the movable furniture part 2.

Figure 18:
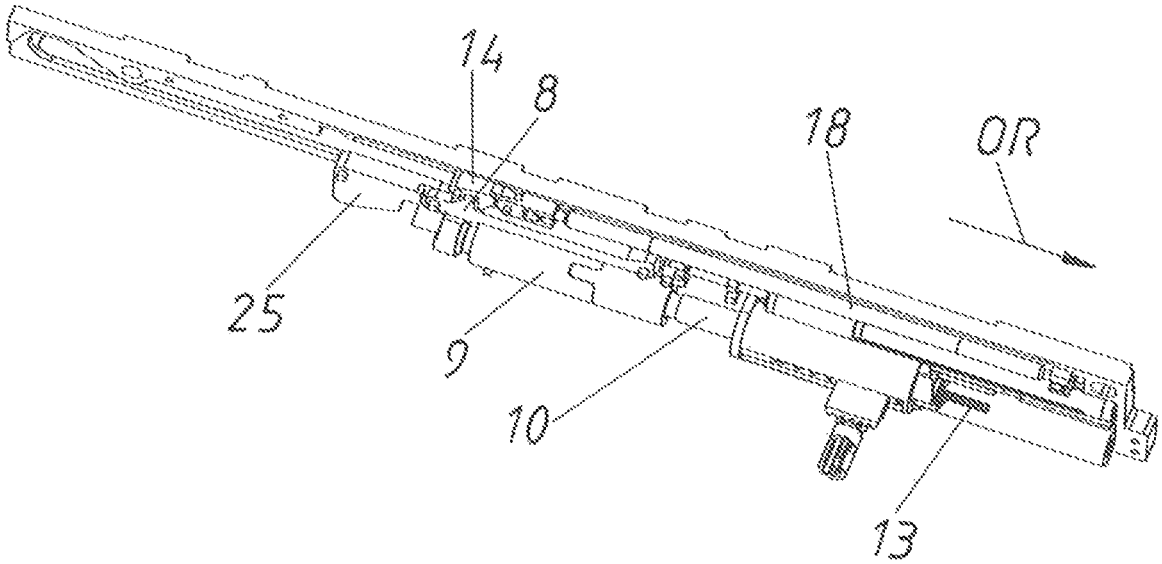
Figure 18:
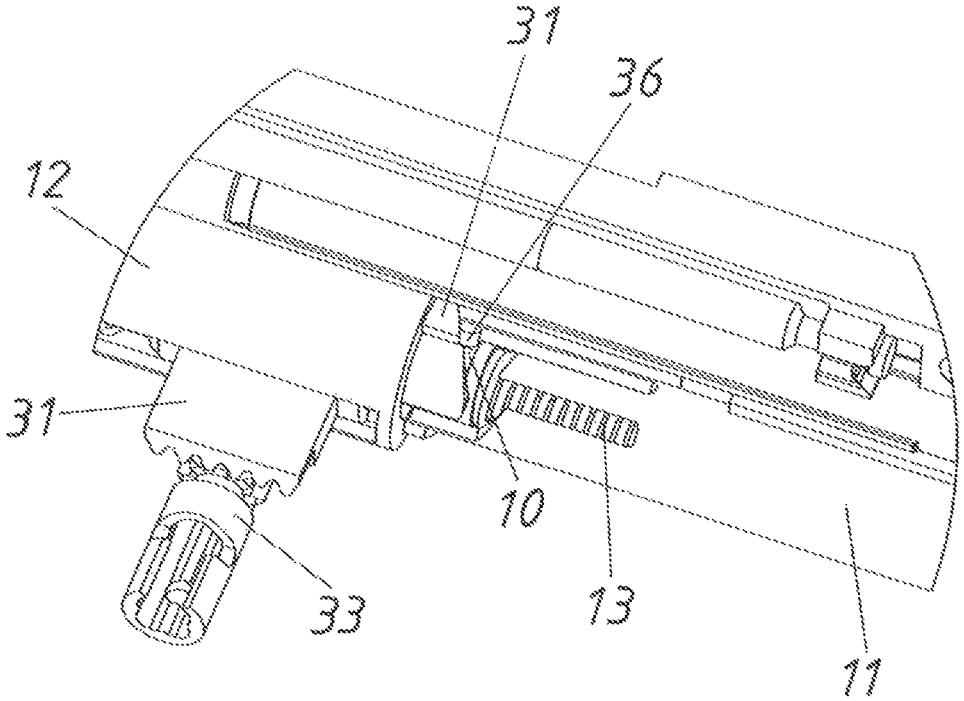

If then, starting from the over-pressing position US, the movable furniture part 2 is no longer pressed, the ejection force storage member 13 can start to relax according to FIG. 18. This relaxing ejection force storage member 13 thereby presses onto the ejection slider 10, and the locking pin 36 abuts the front face of the locking element 58 of the synchronizing coupling piece 31. As a consequence, the whole synchronizing coupling piece 31 is moved relative to the ejection housing 11, 12. By this movement, the gear rack of the synchronizing coupling piece 31 also meshes with the gear wheel of the synchronizing coupling counter piece 33 (see detail of FIG. 18). Thus, also in the drive device arranged on the other side of the movable furniture part 2 (not shown), an unlocking is triggered (see still later FIG. 33). By the beginning relaxation of the ejection force storage member 13 also the housing 6, 7 is moved relative to the ejection element 10, to the coupling element 9, to the push element 8 and to the catch hook 25 in opening direction OR. As the push element 8 entrains the retraction latch 14 via the push nose 60, also the tensioning of the retraction force storage member 18 begins. Therefore, the spring force of the ejection force storage member 13 is larger than the spring force of the retraction force storage member 18. For explanation in each of the FIGS. 16 to 18 part sections, especially of the outer ejection housing 12, are partly hidden so that a better insight into the interior of the ejection housing 11, 12 is possible.

Figure 19:
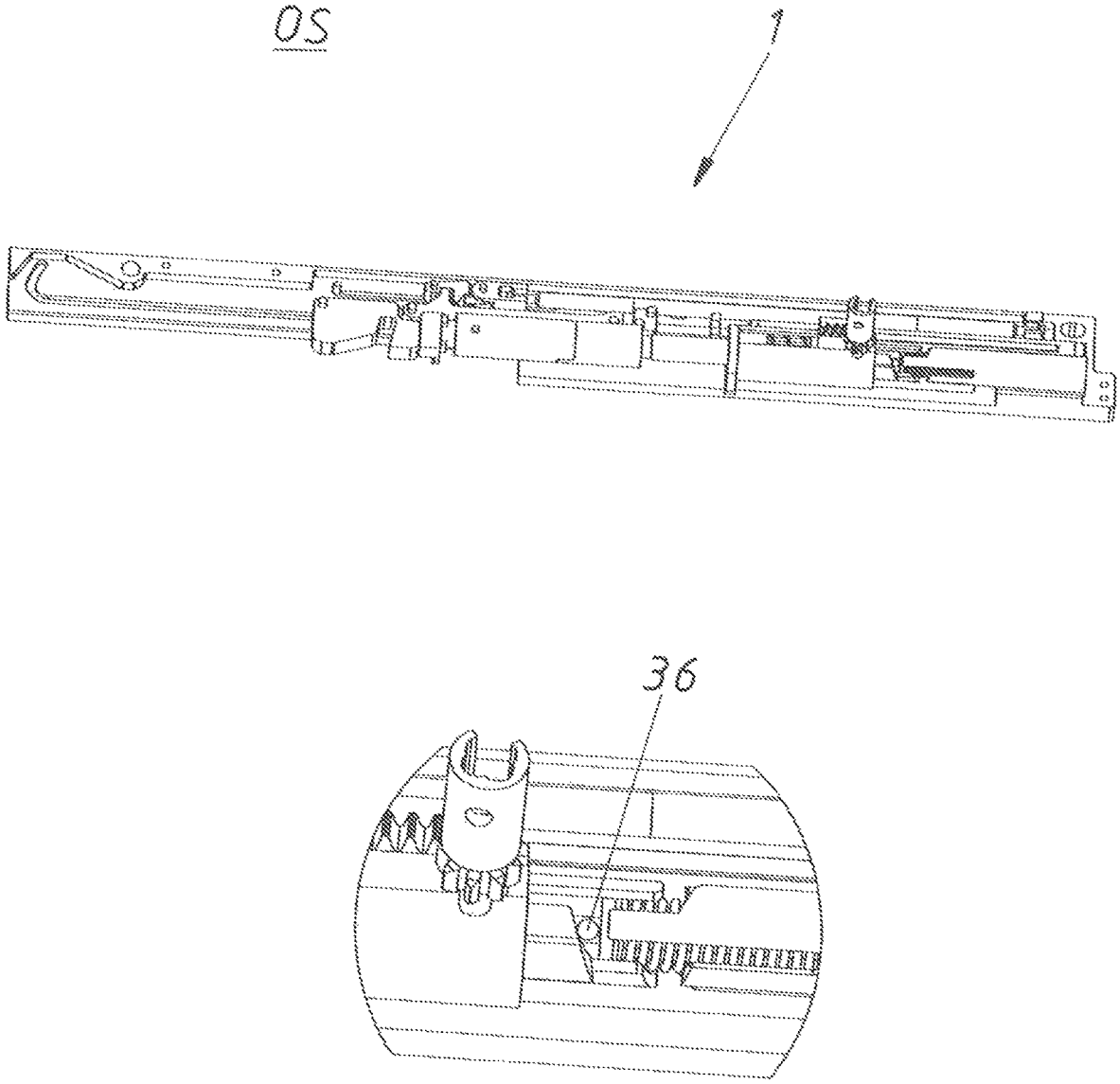

According to FIG. 19, the movable furniture part 2 has been still further ejected and a first slight open position OS is reached. Because of the design of the locking guide track 41 in the outer ejection housing 12—as can be seen in the detailed view from below—the locking pin 36 is further deflected so that this locking pin 36 is evading the locking element 58 (see also FIG. 11). As the locking pin 36 in this position also no longer presses onto the synchronizing coupling piece 31, the synchronizing force storage member 32 can relax and moves the synchronizing coupling piece 31 again into the position e. g. according to FIG. 16.

Figure 20:
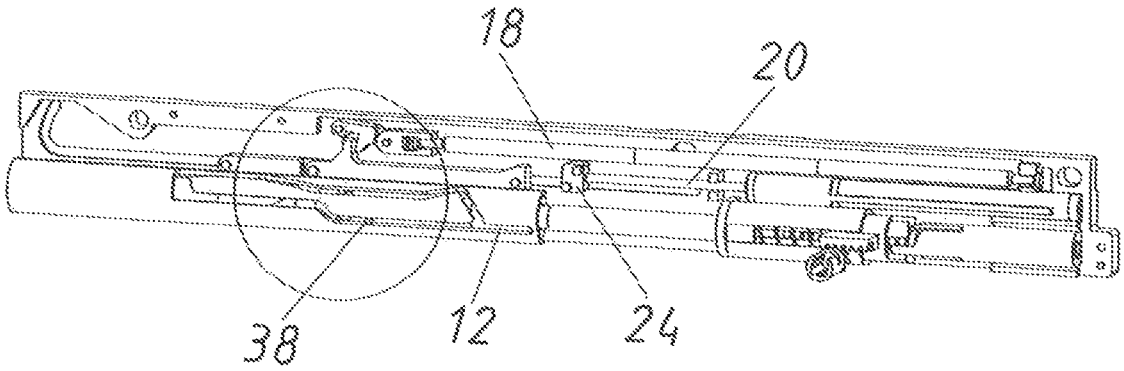
Figure 20:
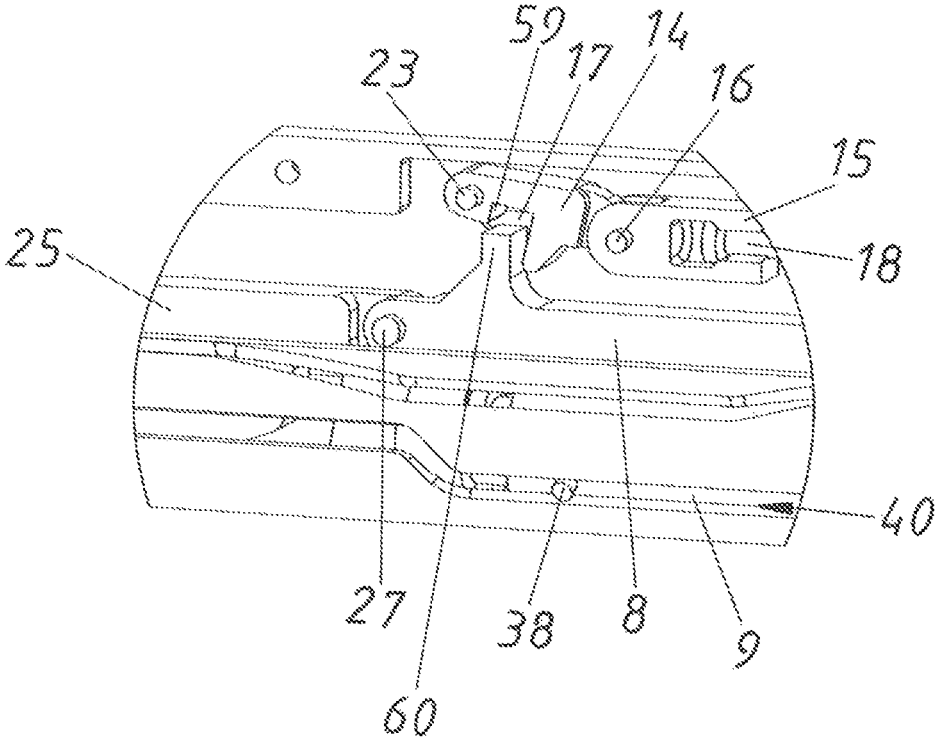

In FIG. 20, the ejection or opening movement has further continued. The ejection force storage member 13 is relaxed already for a large part, at least so far that the retraction force storage member 18 is fully tensioned. In this fully tensioned position of the retraction force storage member 18 the retraction latch 14 has been pivoted about the retraction connecting pin 16 relative to the retraction slider 15 so that the retraction locking pin 23 is locked in the angled end section of the retraction locking track 17 (see detail of FIG. 20). By this pivoting movement also the push nose 60 of the push element 8 no longer abuts in the catch section 59 of the retraction latch 14. In this FIG. 20, it is also recognizable that the intermediate piece 24 has reached an end abutment of the intermediate piece guide track 39 because of the trail movement of the damping piston 20. Further, it is particular important to mention in connection with FIG. 20 (as also with the following drawings) that the housing cover 6 is partly unhidden. This housing cover 6 is cut or unhidden so far that in the remaining illustrated housing cover 6 the control track 40 exactly remains. This illustration only serves for demonstrative reasons. Thus, it can be seen in FIG. 20 that the control pin 38 on the coupling element 9 has already traveled a significant part of the ejection control track section 61 (see also FIG. 15).

In each upper entire view of the FIGS. 21 to 31 an outer region of the housing cover 6 is hidden so that the position of the control pin 38 in the control track 40 is well visible in the remaining inner region of the housing cover 6. In the lower entire views of these FIGS. 21 to 31, this housing cover 6 is completely hidden. Instead, an outer region of the coupling element 9 is hidden each so that the position of the coupling pin 37 in the coupling track 45 is well visible in the remaining inner region of the coupling element 9. Therebetween, always details of each above shown entire view is illustrated.

Figure 21:
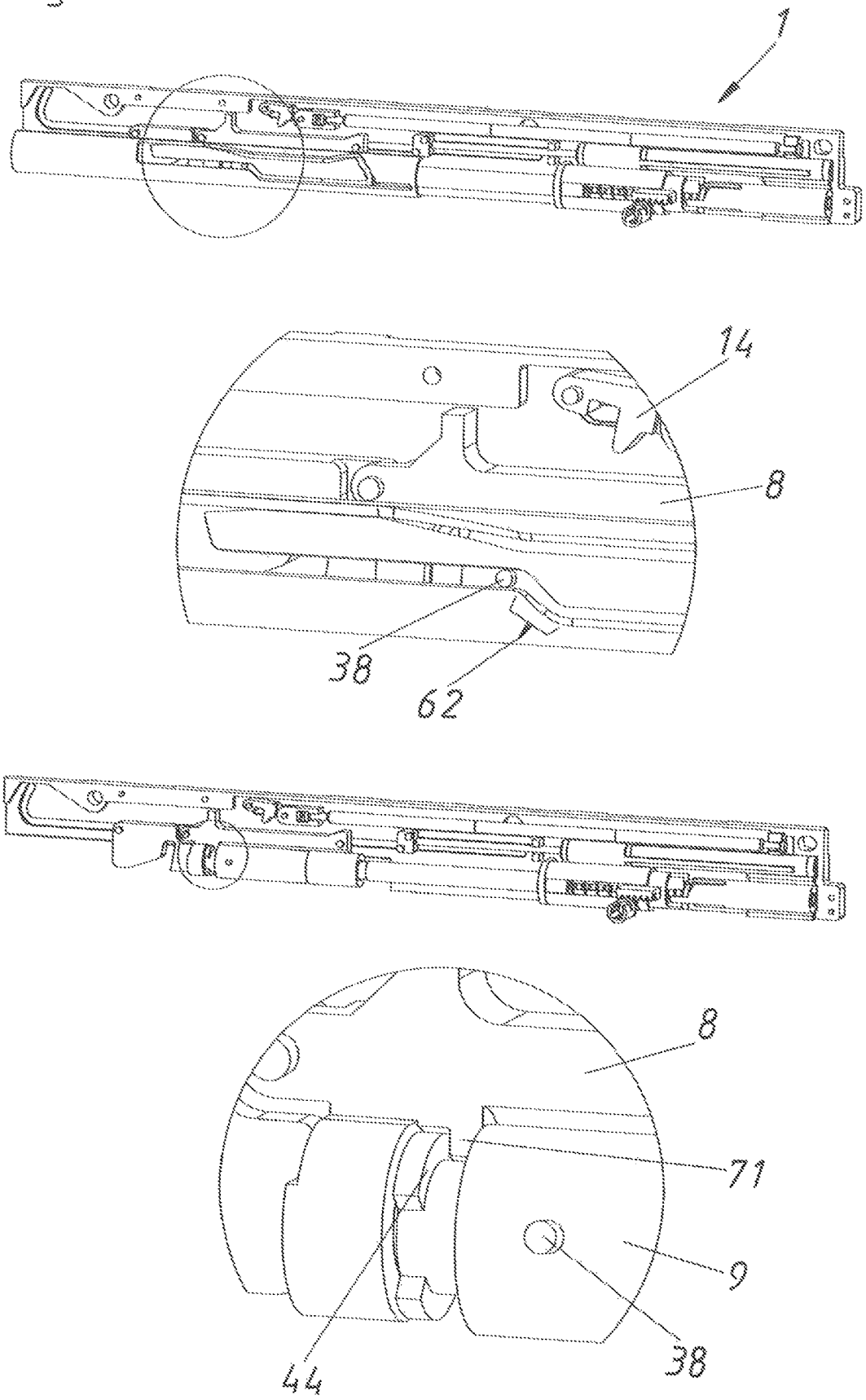

According to FIG. 21, the ejection force storage member 13 has fully relaxed. As a consequence, in the upper detail of FIG. 21, it is visible on the one hand that the push element 8 has still further moved away from the retraction latch 14 of the tensioned retraction device 4. On the other hand, the control pin 38 has moved through the coupling control track section 62 of the control track 40. As a consequence, a rotational movement of the coupling element 9 relative to the housing cover 6 is triggered, whereby the bayonet-like coupling part 44 of the coupling element 9—as shown in the lower detail of FIG. 21—couples on a projection 71 formed on the push element 8. Thereby, the uncoupling position EK is no longer given, but rather the coupling position K between the push element 8 and the coupling element 9 is reached. Starting from this position according to FIG. 21, the further opening movement is carried out without an influence by one of the force storage members 13 or 18. The further opening movement can still be effected by the momentum of the force which has been introduced by the ejection force storage member 13 into the movable furniture part 2, or by actively pulling the movable furniture part 2.

Figure 22:
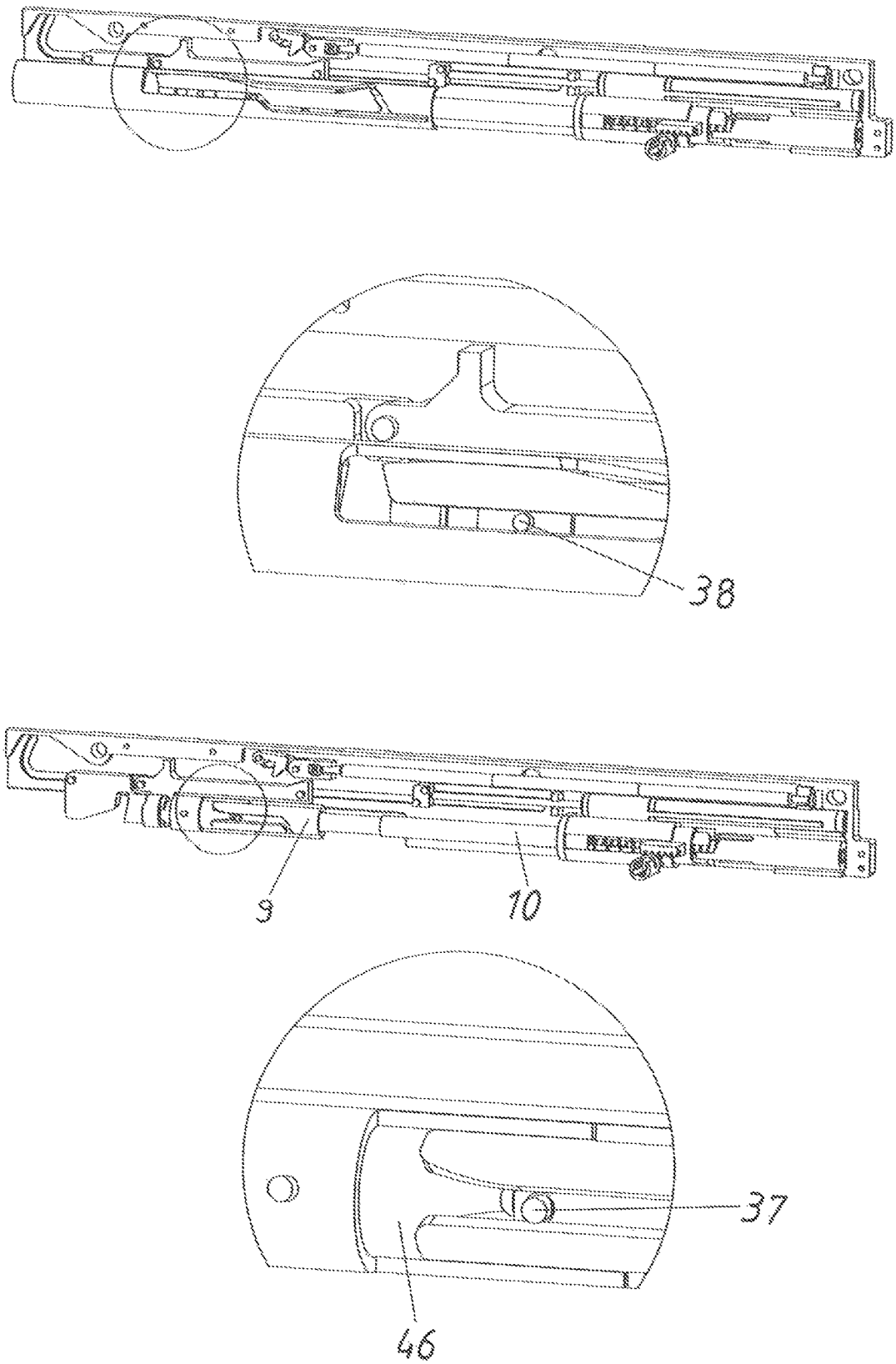

By this further opening movement according to FIG. 22 the control pin 38 is further moved through the shifting control track section 63 of the control track 40. Starting from the position according to FIG. 21 also the ejection slider 10 can no longer be moved further as an end abutment for the locking pin 36 in the ejection housing 11, 12 is reached (not shown). As starting from reaching the coupling position K the coupling element 9 is jointly moved by the push element 8 in the case of a further opening movement, a relative movement of the coupling element 9 to the ejection slider 10 is effected. As a consequence, the coupling pin 37 arranged on the end of the ejection slider 10 remote from the ejection force storage member 13 travels from the freewheel section 46 into the guiding and idling section 47 of the coupling track 45 in the coupling element 9. For explanation in this detail—similar to the housing cover 6 in the upper detail—a radially outer region of the coupling element 9 is hidden so that a direct view onto the remaining coupling track 45 in the coupling element 9 is possible. Also this only serves for demonstration.

Figure 23:
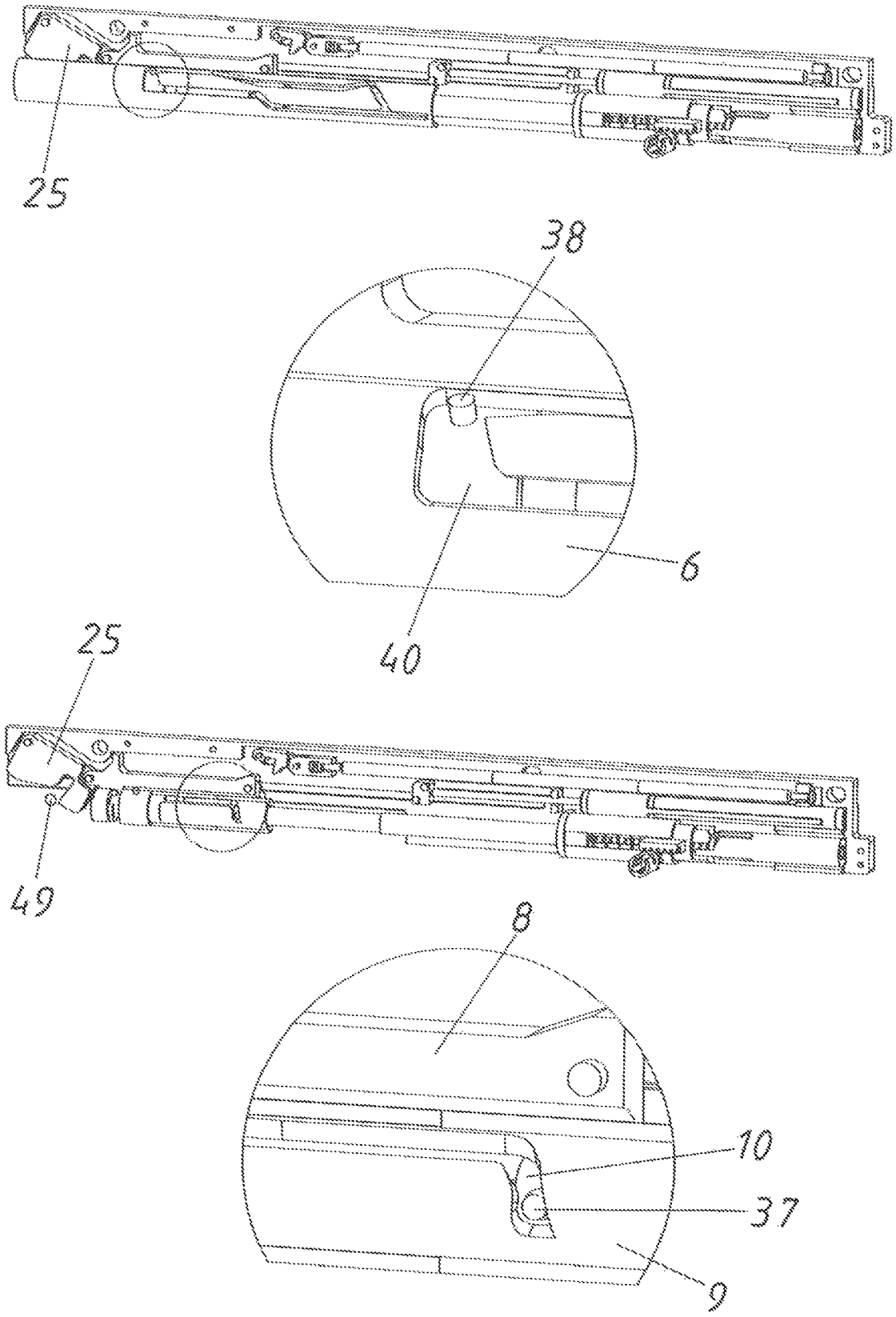

Finally, according to FIG. 23, the remaining opening path also is completed so that the catch hook 25 has been deflected into the angled end section of the guide track 28. The catch hook 25 is held in this position by the catch hook force storage member 26. According to the lower detail of FIG. 23 also the coupling pin 37 on the ejection slider 10 has moved in the angled holding section 48 of the coupling track 45 of the coupling element 9 with this remaining opening movement. By the inclined design of the coupling track 45 in the holding section 48 the coupling element 9 is rotated relative to the ejection element 10. This rotational movement also causes that according to the upper detail of FIG. 23 the control pin 38 has been moved through the redirecting control track section 64 of the control track 40. In FIG. 23 the entrainment member 49 only just has contact to the catch hook 25.

Figure 24:
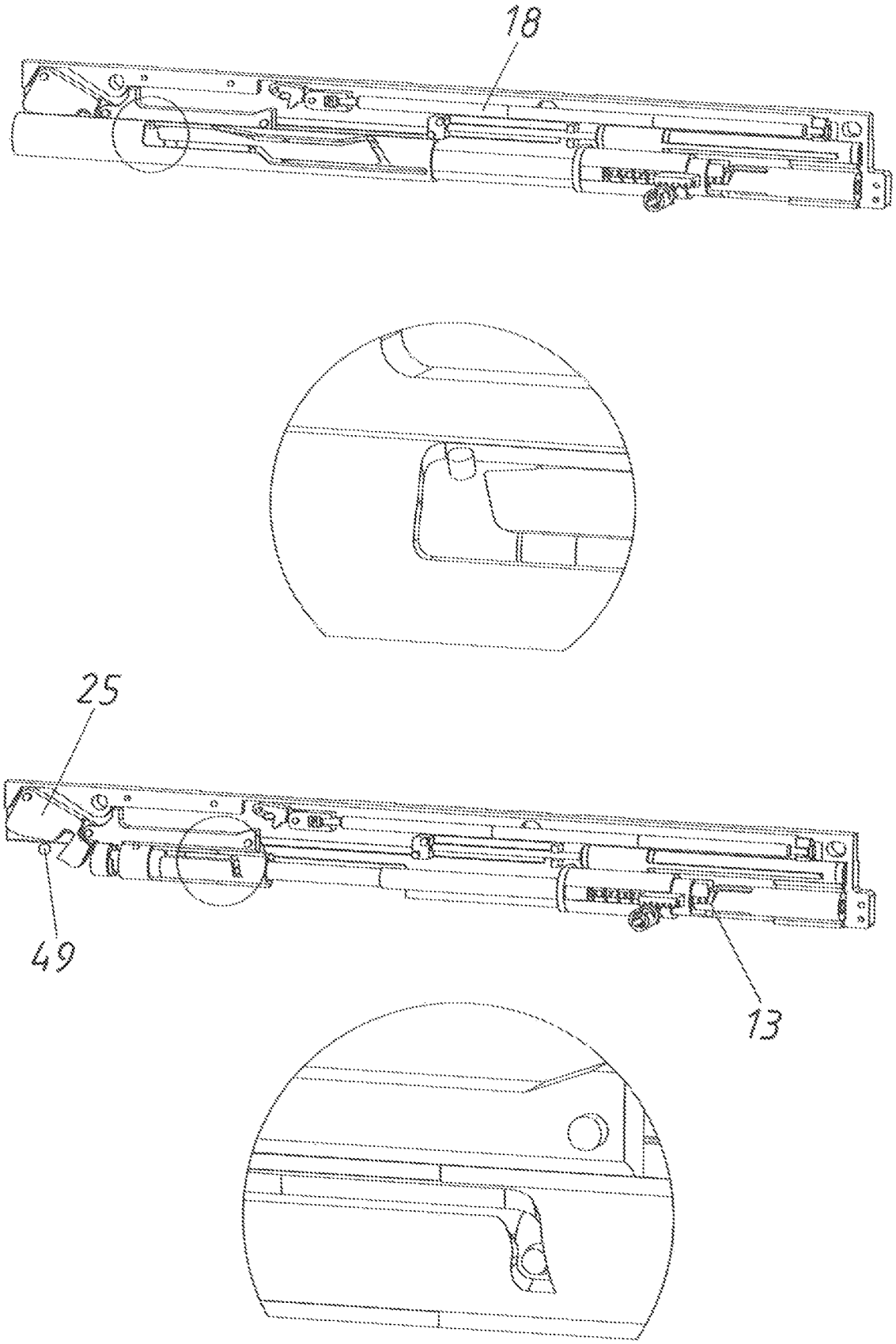

In contrast, in FIG. 24 the entrainment member 49 already has lifted or moved away from the catch hook 25. Thereby, the movable furniture part 2 is in a freewheel. During this freewheel, all components of the drive device 1 remain in the position. This means, the retraction force storage member 18 is tensioned and the ejection force storage member 13 is relaxed.

According to FIG. 15, the closing movement of the movable furniture part 2 begins. As the entrainment member 49 is reaching contact with the catch hook 25, the catch hook 25 is released from the angled end section of the guide track 28 against the force of the catch hook force storage member 26. According to FIG. 25 the coupling element 9 has already been displaced slightly to the right by means of the push element 8 abutting the coupling element 9. As the ejection element 10 is actuated by the ejection force storage member 13, the coupling pin 37 touches the holding surface 72 of the control track 45 according to the lower detail of FIG. 25. The holding surface 72 is oriented rectangular to the longitudinal axis L or is formed slightly undercut. As in this case the forces of the coupling element 9 substantially vertically act onto the coupling pin 37, the coupling pin 37 is jointly moved by the coupling element 9 in the case of a further pushing movement. In the case of the pushing movement the control pin 38 is moved through the straight tensioning control track section 65 of the control track 40. This is particularly caused by the fact that the coupling pin 37 is in contact with the undercut holding surface 72.

Figure 25:
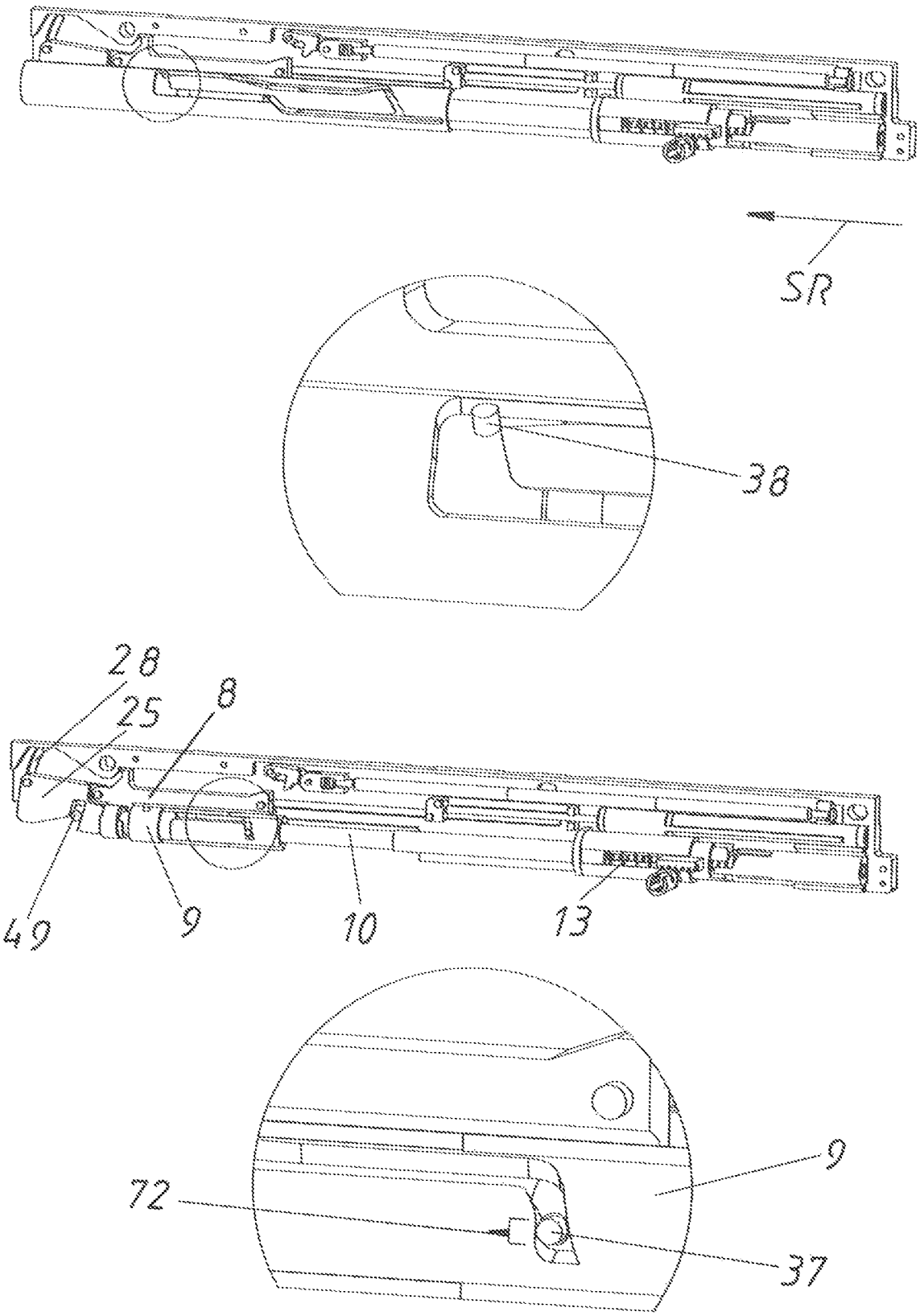
Figure 26:
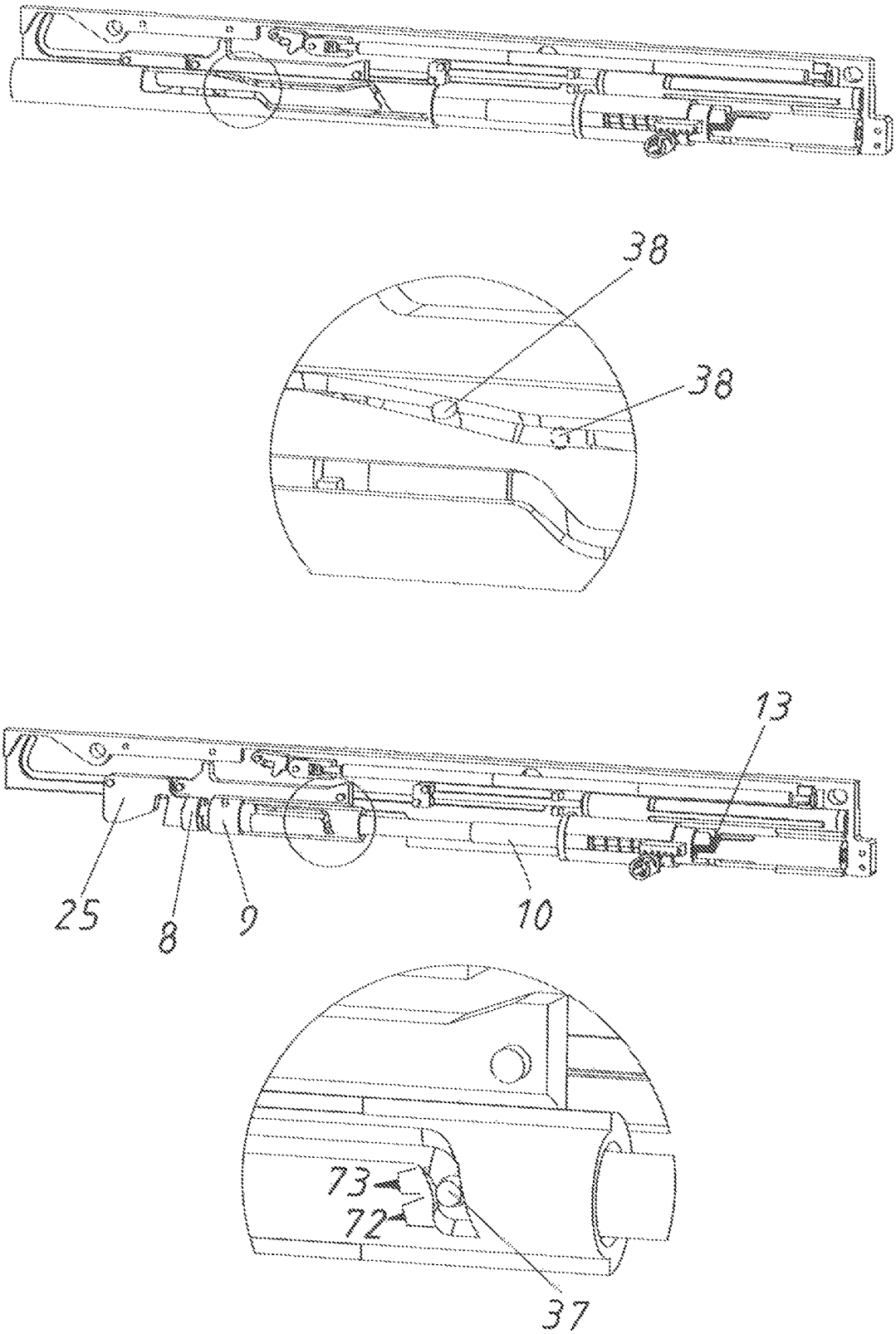

The ejection force storage member 13 is tensioned from the position according to FIG. 25 to the position according to FIG. 26 as the ejection element 10 is moved by means of the catch hook 28, the push element 8 and the coupling element 9 against the force of the ejection force storage member 13 by way of the coupling pin 37 abutting the holding surface 72 of the control track 45. In FIG. 26 the control pin 38 has already traveled a part of the path in the deflection control track section 66 of the control track 40. This deflection control track section 66 causes a rotation of the coupling element 9 relative to the housing cover 6. By this rotation of the coupling element 9, the coupling pin 37 is simultaneously released from the holding surface 72 of the coupling track 45 according to the lower detail of FIG. 26 and reaches an inclined section 73 of the control track 45. In the case of abutting this inclined section 73, the ejection force storage member 13 is still tensioned. Because of the contact to the inclined section 73 the coupling pin 37 wants to evade upwards relative to the inclined section 73 and wants to push the coupling element 9 respectively. However, both movements are not yet possible in the position according to FIG. 26. A further downward movement of the coupling element 9 relative to the coupling pin 37 is indeed possible only so far until the control pin 38 attached to the coupling element 9 abuts the holding control track section 67 of the control track 40. This means, in the position of the control pin 38 indicated in dashed lines in the upper detail of FIG. 26, the relative movement between the housing cover 6 and the coupling element 9 has not yet progressed so far that the coupling pin 37 could come to the guiding and idling section 47 of the coupling track 45. On the other hand, an upward movement of the coupling pin 37 relative to the coupling pin 9 is not possible as the locking pin 36 on the end of the ejection slider 10 facing the ejection force storage member 13 cannot yet move upwards as the locking pin 36 is still located in the tensioning section 78 of the locking guide track 41.

Figure 27:
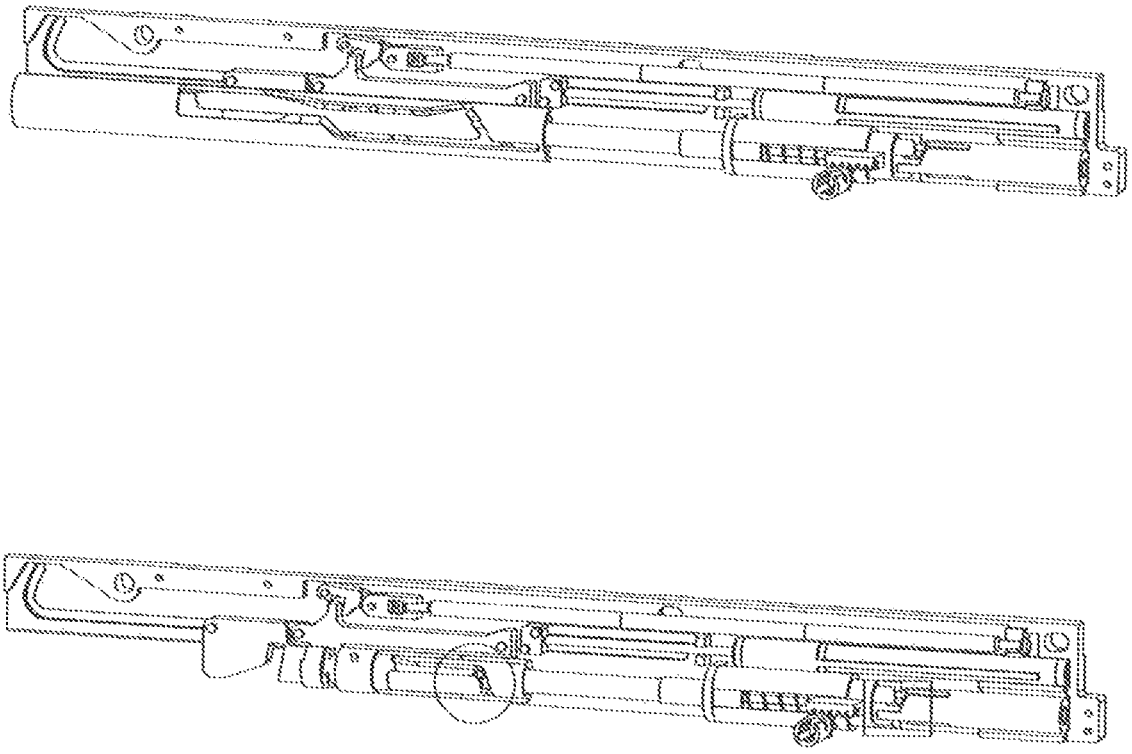

In FIG. 27, however, the ejection force storage member 13 is now tensioned so far that the locking pin 36 is no longer held in the tensioning section 78 but rather is able to reach a curved section 79 of the locking guide track 41. This movement of the locking pin 36 into the curved section 79 is carried out in a controlled manner by means of the coupling track 45. This means, as can be seen in the left detail of FIG. 27, the coupling pin 37 indeed abuts the inclined section 73 of the control track 45. As the locking pin 36 has reached the curved section 79, the ejection slider 10 is not able to rotate.

Figure 28:
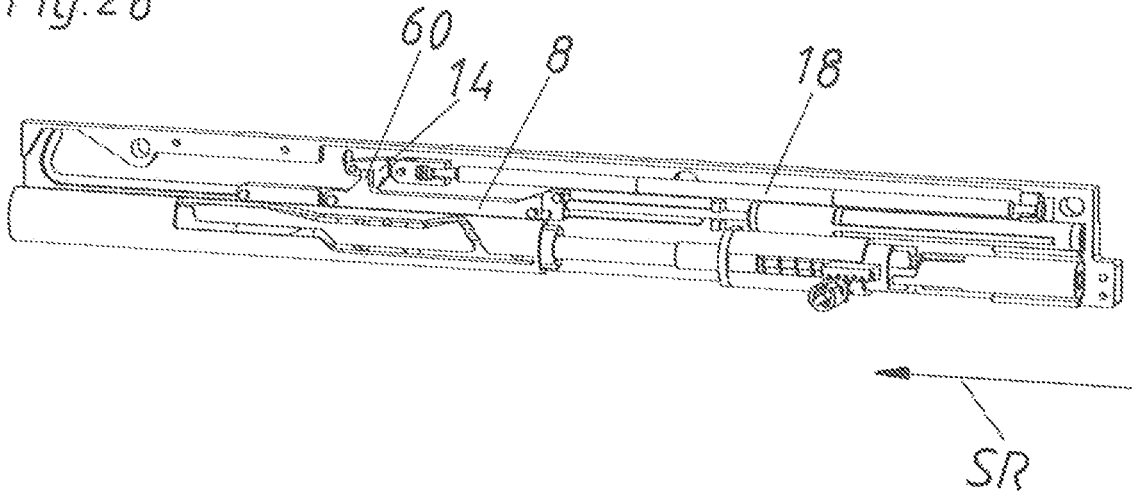
Figure 28:
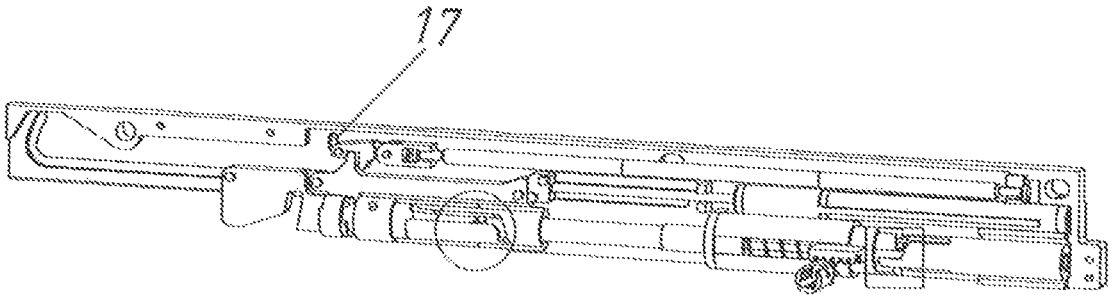
Figure 28:
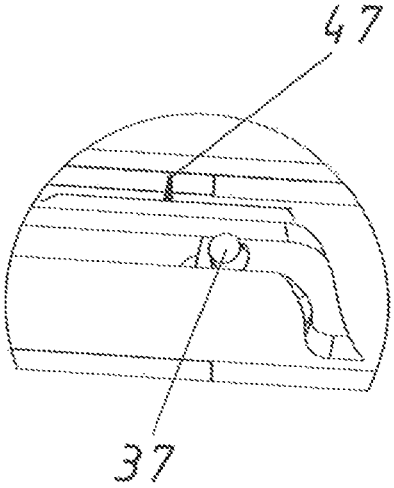
Figure 28:
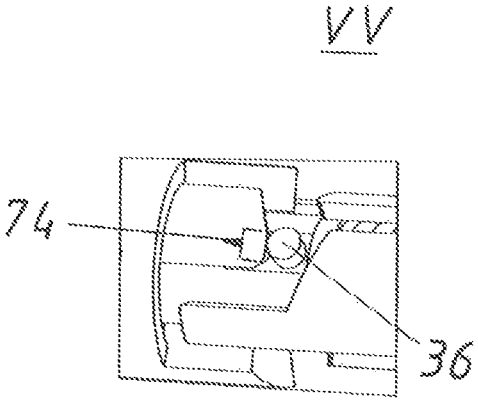

This rotational movement is coordinated in such a manner that the coupling pin 37 reaches the guiding and idling section 47 when the locking pin 36 is exactly located in a pre-locking section 74 of the locking guide track 41 (see FIG. 28). The pre-locking section 74 is oriented rectangular to the longitudinal axis L. While the locking pin 36 is located in this pre-locking section 74, the ejection force storage member 36 is tensioned and a pre-locking position VV is reached. For details to this pre-locking position VV it shall exemplarily be referred to WO 2014/165878 A1. This pre-locking position VV enables a through-pressing protection so that an undesired unlocking is not immediately occurring when closing. In FIG. 28 it is also recognizable that directly after reaching the pre-locking position VV or with reaching this position the push nose 60 of the push element 8 engages the retraction latch 14 and releases this retraction latch 14 from the angled end section of the retraction locking track 17. As a consequence, the retraction force storage member 18 starts to relax and the movable furniture part 2 is actively retracted in closing direction SR.

Figure 29:
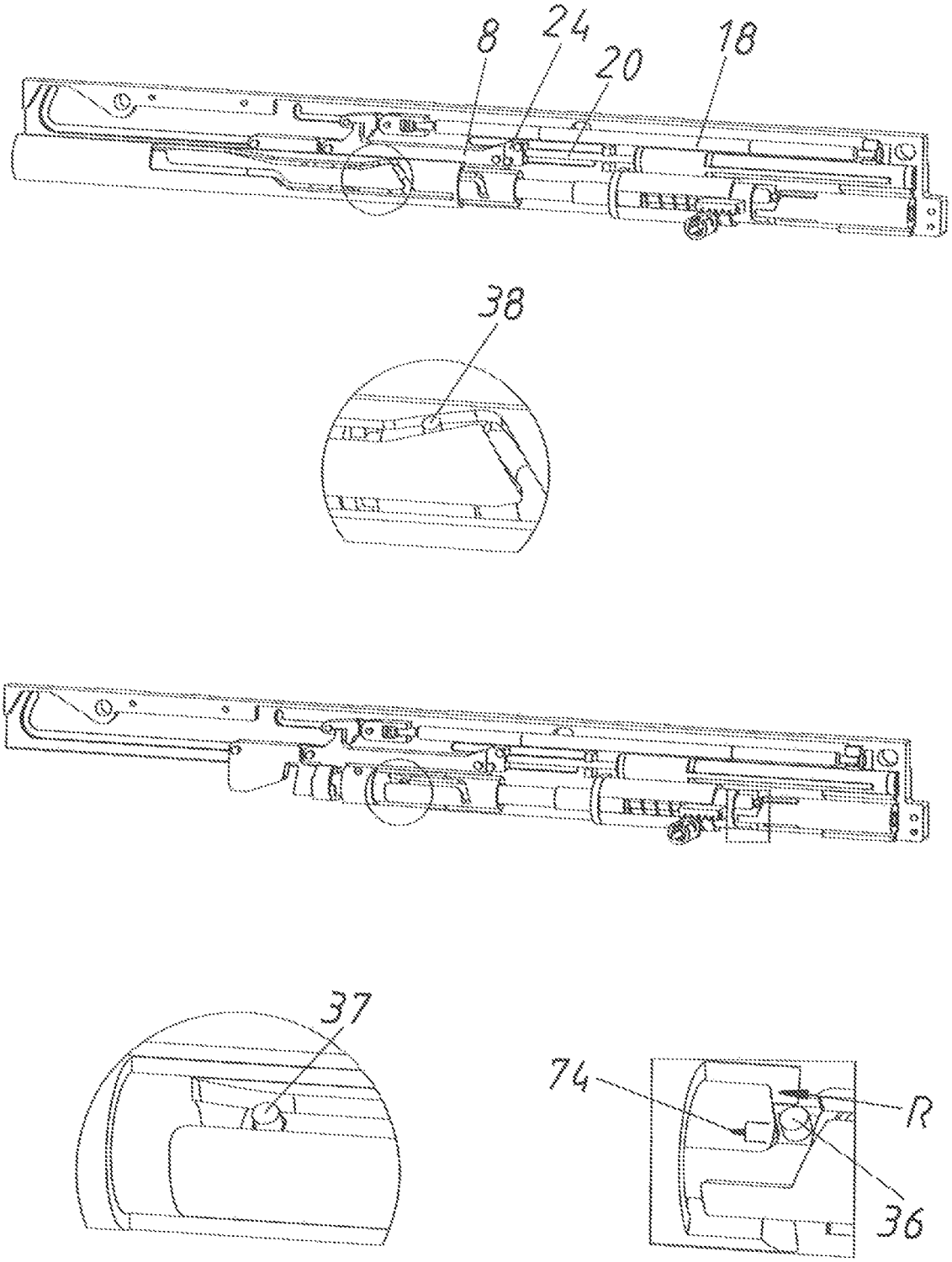

In FIG. 29, about the half of the retraction path is already traveled. The retraction force storage member 18 has already relaxed for a large part. This retraction movement is damped by the damping piston 20 of the damping device 5 as the damping piston 20 acts in a braking manner onto the push element 8 via the intermediate piece 24. In the upper detail of FIG. 29, the control pin 38 has reached the latching control track section 68 of the control track 40. By the inclined design of this latching control track section 68 the coupling element 9 rotated upwards relative to the housing cover 6. As the coupling pin 37 simultaneously abuts the guiding and idling section 47 of the upward rotating coupling track 45, also the ejection slider 10 is slightly rotated upwards. As a consequence, according to the lower right detail of FIG. 29 the locking pin 36 is moved away from the pre-locking section 74 and moves along the latching slope into the latch recess R of the locking device 56. Thus, also the movement of the locking pin 36 from the pre-locking section 74 into the latch recess R is controlled by means of the control track 40 and the coupling track 45 and the corresponding control pin 38 and coupling pin 37. Therefore, a smooth and quiet placing of the locking pin 36 in the latch recess R is reached. The control track 40, the control pin 38 guided in the control track 40, the coupling track 45 in the coupling element 9 and the coupling pin 37 guided in the coupling track 45 and arranged on the ejection slider 10 together form the control device for controlling the movement of the locking pin 36 arranged on the ejection slider 10 and guided in the locking guide track 41.

Figure 30:
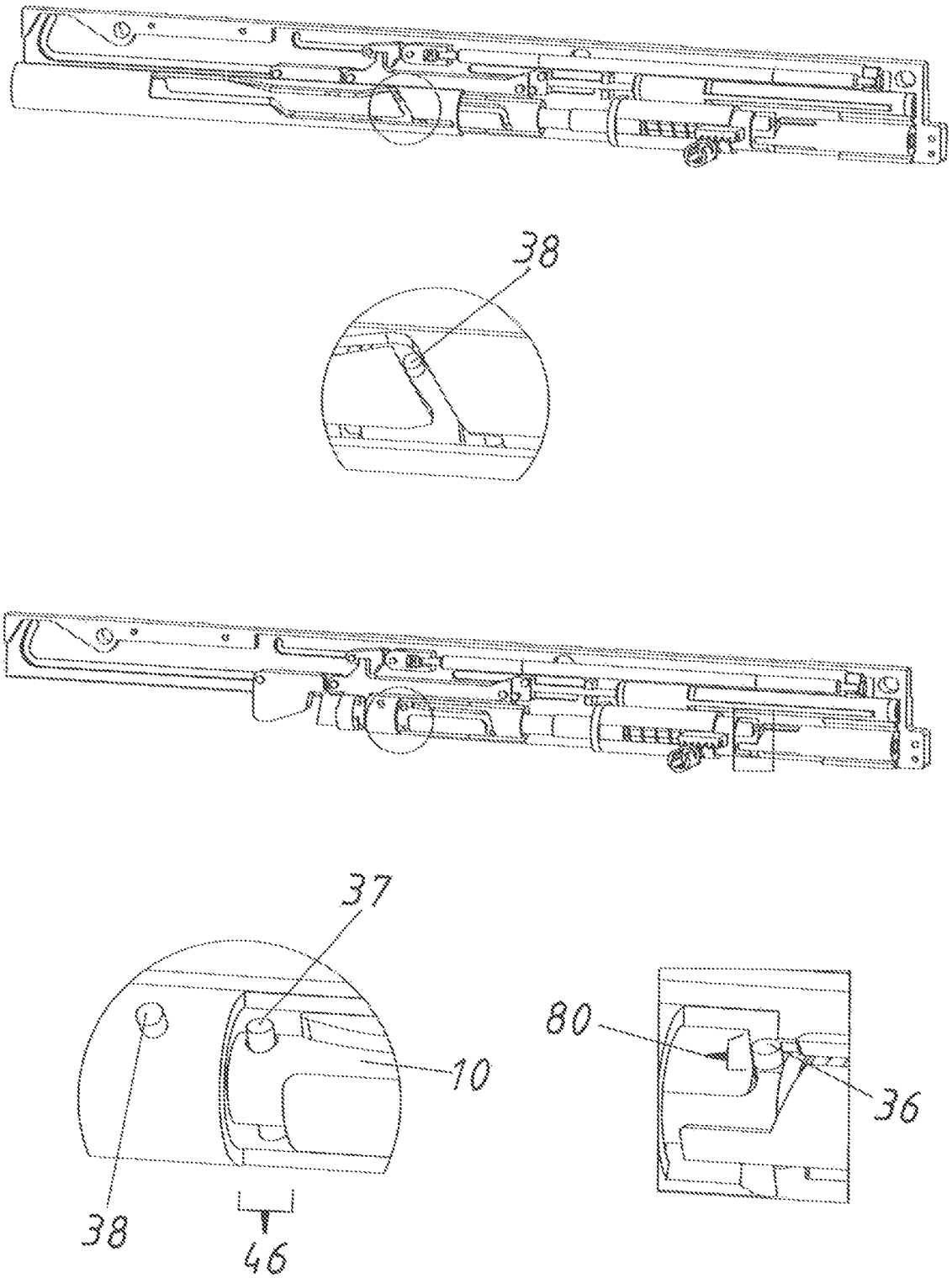

According to FIG. 30, the locking pin 36 has finally reached the latch recess R and the locking device 56 is in the locking position VS. Simultaneously, the coupling pin 37 is in the freewheel section 46 of the coupling track 45 according to the detail bottom left. In the upper detail the control pin 38 has moved into the uncoupling control track section 69 of the control track 40. As a consequence, a rotational movement of the coupling element 9 relative to the housing cover 6 about 70° to 150°, preferably about circa 120°, is triggered. In order to not hinder this relatively large rotational movement of the coupling element 9, the coupling pin 37 is located in the freewheel section 46 of the coupling element 9 as the ejection slider 10 indeed cannot rotate because of the locking of the locking pin 36. Also the ejection slider 10 is freely rotatable relative to the coupling element 9 by this freewheel section 46. The retraction movement by the retraction device 4 is almost completed in FIG. 30.

Figure 31:
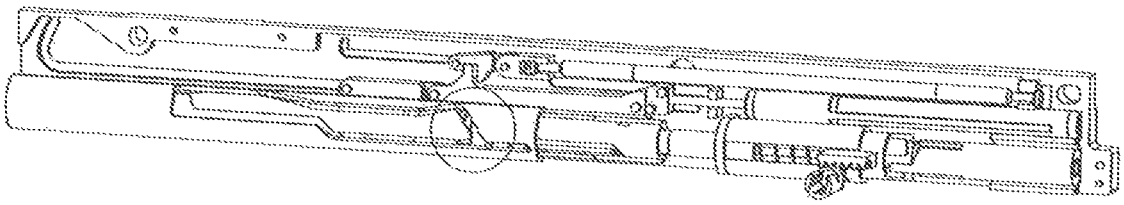
Figure 31:
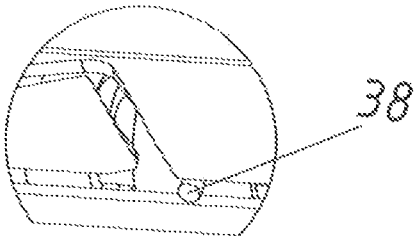
Figure 31:
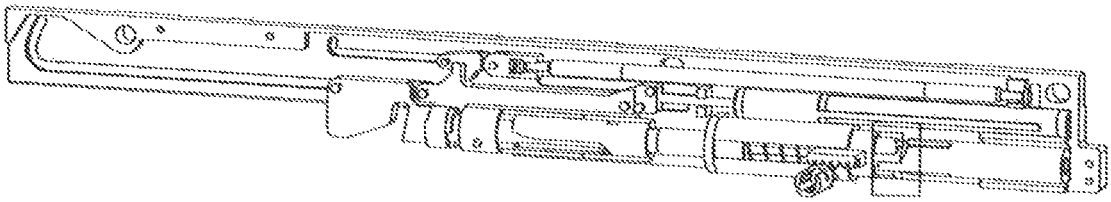
Figure 31:
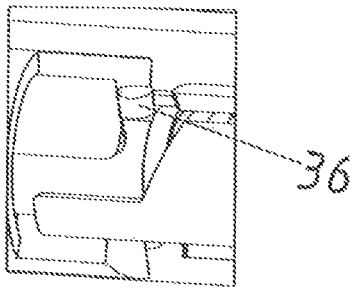

In FIG. 31, finally, the closed position SS of the movable furniture part 2 is reached. The control pin 38 is again located in an uncoupling region EK of the control track 40, whereby the coupling between the coupling element 9 and the push element 8 is released. FIG. 31 again corresponds to the starting position according to FIG. 15.

Figure 32:
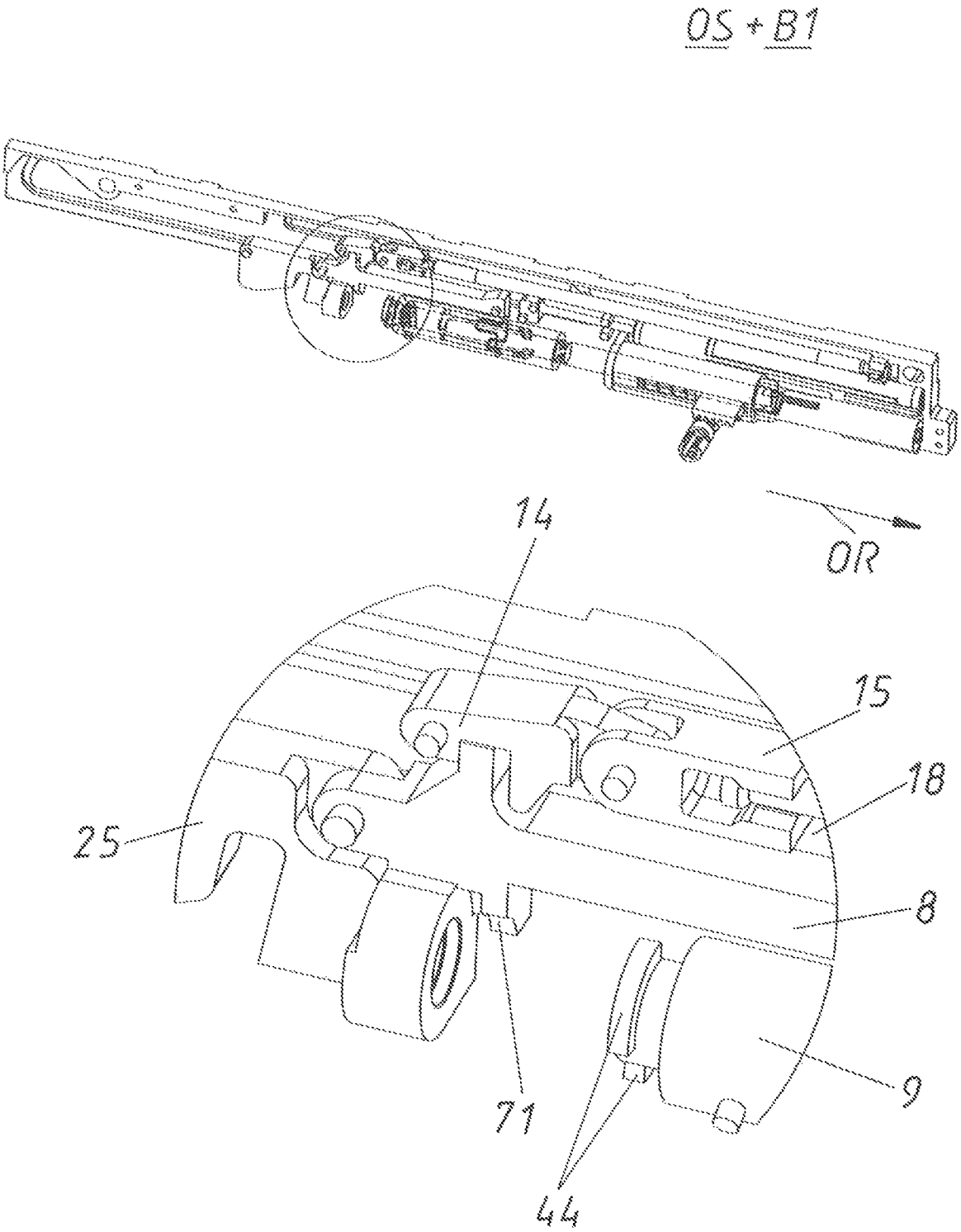

In FIG. 32 a further important function of the present drive device 1 is recognizable. With the present drive device 1 it is specifically possible, without having to use an overload device or other auxiliary devices, to pull the movable furniture part 2 from the closed position SS in opening direction OR without generating damages. This means, not only an opening of the movable furniture part 2 by over-pressing and thus triggered unlocking as in the second operating mode B2 is possible, but rather also a pulling of the movable furniture part 2 can be carried out. This is possible in such a way that in the closed position SS the coupling element 9 is uncoupled from the push element 8. As a consequence, the locking device 56 maintains the locking position VS and also the ejection device 3 remains unchanged. By this opening by pulling in the first operating mode B1 only the retraction device 4 is actively and manually tensioned so that in the case of a further closing a smooth closing sequence is guaranteed. For detailed information to this function it can exemplarily be referred to WO 2014/165873 A1.

In principle it is possible that the drive device 1 comprises separate entrainment members for coupling the ejection device 3 and the retraction device 4 with the movable furniture and with the furniture carcass 51 respectively. For a simple design and mounting, however, it is preferably provided that the drive device 1 comprises only one entrainment member 49. The ejection device 3 as well as the retraction device 4 can be triggered by means of this single entrainment member 49. The first operating mode B1 can be activated by this entrainment member 49 by pulling the movable furniture part 2 situated in the closed position SS. The second operating mode B2 can be activated by this entrainment member 49 by pressing onto the movable furniture part 2 situated in the closed position SS.

Figure 33:
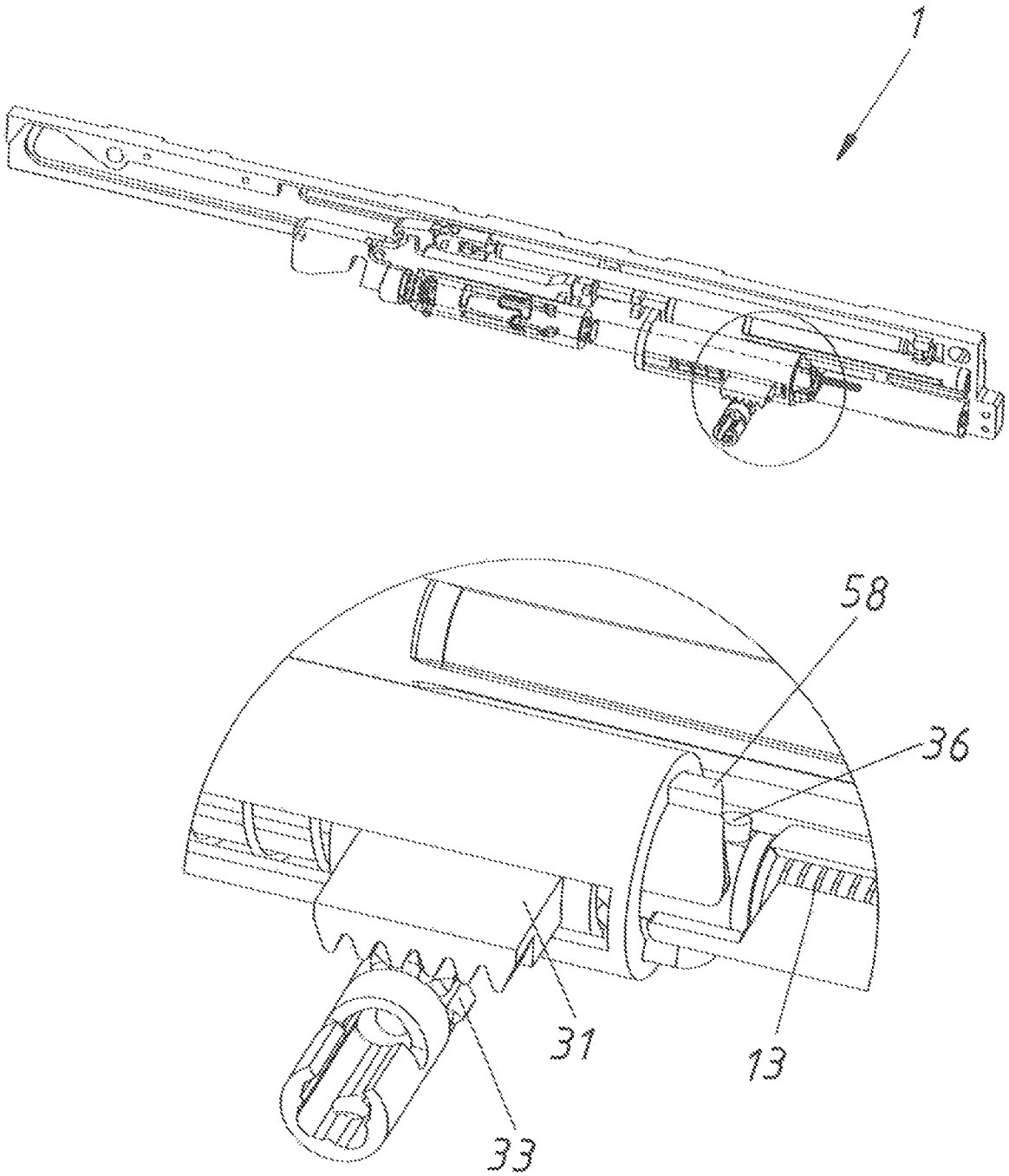

A further function of the drive device 1 is illustrated in FIG. 33. According to this illustration the unlocking of the locking pin 36 from the latch recess is not carried out by over-pressing, but rather in such a way that the drive device located on the other side (shown in FIG. 2) is unlocked by over-pressing. By way of the locking device 56 of the other drive device and especially by the synchronizing coupling piece 31 moving during opening, a movement is transmitted to the synchronizing coupling counter piece 33 and the synchronizing rod 76 (shown in FIG. 2) so that in the case of the drive device 1 shown in FIG. 33 also the synchronizing coupling piece 31 is moved while the just beginning opening movement. As the synchronizing coupling piece 31 is integrally formed with the locking element 58, the locking element 58 does no longer jointly form the latch recess R, whereby the locking pin 36 is able to reach the ejection section because of the inclined locking guide track 41 and because of the spring-actuation by the ejection force storage member 13. For details to this function it shall exemplarily be referred to WO 2015/051386 A2.

Figure 34:
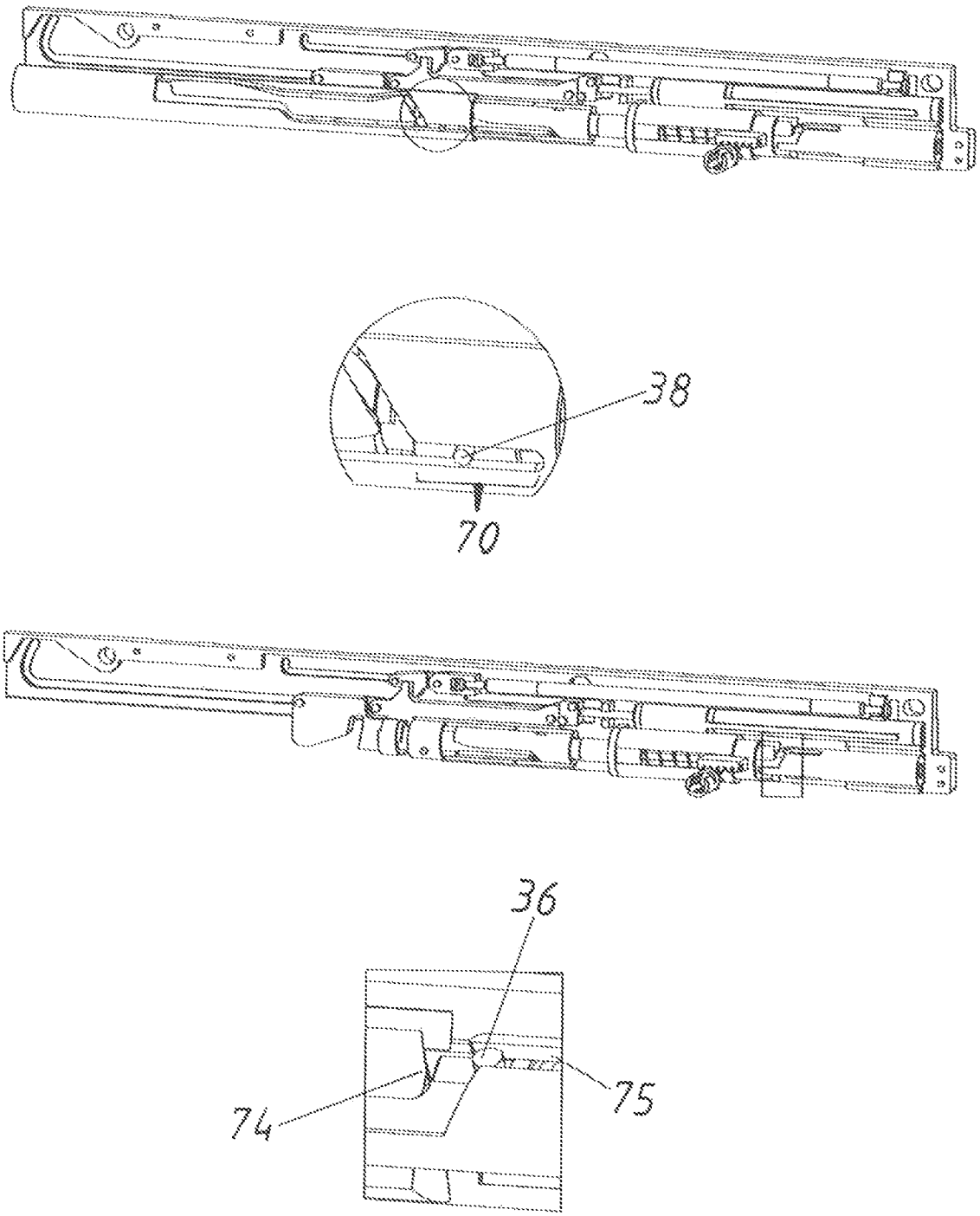

Finally, it shall be referred to the FIG. 34 in which a through-pressing movement is illustrated. In the case of this through-pressing movement the locking pin 36 is moved from the pre-locking section 74 into the through-pressing track 75 of the locking guide track 41. Simultaneously, also the control pin 38 is located in a through-pressing control track section 70 of the control track 40. By this function and especially by the through-pressing track 75 it is prevented that a direct through-pressing and thus over-pressing and triggering happens when closing. Thus, the locking pin 36 cannot directly reach the ejection section of the locking guide track 41.

LIST OF REFERENCE SIGNS

1, 1' drive device
2 movable furniture part
3 ejection device (first ejection device)
3' further ejection device (second ejection device)
4 retraction device
5 damping device
6 housing cover
7 housing base plate
8 push element
9 coupling element
10 ejection slider
11 inner ejection housing
12 outer ejection housing
13 ejection force storage member
14 retraction latch
15 retraction slider
16 retraction connecting pin
17 retraction locking track
18 retraction force storage member
19 retraction force storage member base
20 damping piston
21 damping cylinder
22 damping piston guide
23 retraction locking pin
24 intermediate piece
25 catch hook
26 catch hook force storage member
27 catch hook rotary bearing
28 guide track for the catch hook and the push element
29 guiding bolt
30 separating element
31 synchronizing coupling piece
32 synchronizing force storage member
33 synchronizing coupling counter piece
34 synchronizing guide
35 synchronizing rod holder
36 locking pin
37 coupling pin
38 control pin
39 intermediate piece guide track
40 control track
41 locking guide track
42 deflection slope
43 hemisphere-shaped abutment
44 bajonet-like coupling parts
45 coupling track
46 freewheel section
47 guiding and idling section
48 holding section
49 entrainment member
50 item of furniture
51 furniture carcass
52 extension guide
53 carcass rail
54 drawer rail
55 central rail
56 locking device (first locking device and second locking device)
57 opening for the synchronizing coupling piece
58 locking element
59 catch section
60 push nose
61 ejection control track section
62 coupling control track section
63 shifting control track section
64 redirecting control track section
65 tensioning control track section
66 deflection control track section
67 holding control track section
68 latching control track section
69 uncoupling control track section
70 through-pressing control track section
71 projection on the push element
72 holding surface
73 inclined section
74 pre-locking section
75 through-pressing track
76 synchronizing device
77 synchronizing rod
78 tensioning section
79 curved section
80 latching section
R latch recess
EK uncoupling region
K coupling region
SS closed position
US over-pressing position
OS open position
SR closing direction
OR opening direction
VS locking position
ES unlocking position
VV pre-locking position
B1 first operating mode
B2 second operating mode
L longitudinal axis/direction
X rotational axis

The invention claimed is:

1. A drive device for a movable furniture part, comprising:

a first lockable ejection device for ejecting the movable furniture part from a closed position into an open position, the first ejection device including a first locking device with a locking position, in which the first ejection device is locked, and an unlocking position, in which the first ejection device is unlocked, and the first locking device is movable between the locking position and the unlocking position by rotational movement of a first component of the first locking device relative to a second component of the first locking device about a rotational axis oriented parallel to a longitudinal axis of the first ejection device;

a second lockable ejection device for ejecting the movable furniture part from the closed position into an open position, the second ejection device including a second locking device with a locking position, in which the second ejection device is locked, and an unlocking position, in which the second ejection device is unlocked, and the second locking device is movable between the locking position and the unlocking position by rotational movement of a first component of the second locking device relative to a second component of the second locking device about a rotational axis oriented parallel to a longitudinal axis of the second ejection device; and a synchronizing device for synchronizing the first locking device and the second locking device of the first ejection device and the second ejection device, respectively, wherein the longitudinal axis of first ejection device and the second ejection device is oriented parallel to an opening direction of the movable furniture part, wherein the first component of each of the first locking device and the second locking device comprises a locking pin, and the second component of each of the first locking device and the second locking device comprises a cardioid-shaped locking guide track, and the locking pin engages in the locking guide track and is guided and lockable in the locking guide track, wherein the synchronizing device comprises:

two synchronizing coupling pieces each associated with a respective one of the first ejection device and the second ejection device, two synchronizing coupling counter pieces each associated with a respective one of the first ejection device and the second ejection device, and a synchronizing rod connecting the two synchronizing coupling counter pieces, and wherein the synchronizing coupling pieces integrally form one part of the locking guide track of the respective one of the first ejection device and the second ejection device.

2. The drive device according to claim 1, wherein the first locking device and the second locking device are each movable from the locking position into the unlocking position by over-pressing the movable furniture part into an over-pressing position located behind the closed position.

3. The drive device according to claim 2, wherein the over-pressing of the movable furniture part is free from a movement transmission by the synchronizing device and the synchronizing device is movable by at least one of the first ejection device and the second ejection device when moving the movable furniture part in the opening direction.

4. The drive device according to claim 1, wherein the first ejection device and the second ejection device each comprise an ejection force storage member and an ejection slider force-actuated by the ejection force storage member.

5. The drive device according to claim 4, wherein the locking pin of the first locking device and the locking pin of the second locking device are each arranged on the respective ejection slider.

6. The item of furniture according to claim 4, wherein each ejection force storage member is held on an ejection housing.

7. The drive device according to claim 1, wherein in the case of an ejection movement of an ejection slider of a respective one of the first ejection device and the second ejection device, a shifting movement of the synchronizing coupling piece is converted into a rotational movement of the synchronizing rod after the over-pressing.

8. The item of furniture according to claim 1, wherein the synchronizing coupling pieces comprise a locking element which integrally forms a latch recess.

9. The drive device according to claim 1, further comprising for each of the first ejection device and the second ejection device, a housing, wherein the first ejection device and the second ejection device and a respective retraction device for retracting the movable furniture part from an open position into the closed position are arranged in the respective housing.

10. The drive device according to claim 9, wherein for each of the first ejection device and second ejection device, the retraction device comprises a retraction force storage member held on the housing, a retraction locking track formed in the housing, and a lockable retraction slider, wherein the retraction slider is force-actuated by the retraction force storage member and is movable in the retraction locking track.

11. The drive device according to claim 10, wherein the respective retraction device can be tensioned by the first ejection device and second ejection device when ejecting the movable furniture part.

12. The drive device according to claim 10, wherein the first ejection device and second ejection device are each coupleable to the respective retraction device by a push element and a coupling element.

13. An item of furniture comprising a furniture carcass, a movable furniture part, and the drive device according to claim 1 for moving the movable furniture part.

14. The item of furniture according to claim 13, wherein the drive device is arranged on the movable furniture part.

15. The item of furniture according to claim 14, further comprising a pair of extension guides each having a drawer rail, wherein the drive device is arranged on the drawer rail of each of the pair of extension guides for moving the movable furniture part.

16. The drive device according to claim 1, wherein a linear relative movement between the first component and the second component of one of the first ejection device and the second ejection device is transmitted by the synchronizing device into a linear relative movement between the first component and the second component of the other ejection device.

17. A drive device for a movable furniture part, comprising:

a first lockable ejection device for ejecting the movable furniture part from a closed position into an open position, the first ejection device including a first locking device with a locking position, in which the first ejection device is locked, and an unlocking position, in which the first ejection device is unlocked, and the first locking device is movable between the locking position and the unlocking position by rotational movement of a first component of the first locking device relative to a second component of the first locking device about a rotational axis oriented parallel to a longitudinal axis of the first ejection device;

a second lockable ejection device for ejecting the movable furniture part from the closed position into an open position, the second ejection device including a second locking device with a locking position, in which the second ejection device is locked, and an unlocking position, in which the second ejection device is unlocked, and the second locking device is movable between the locking position and the unlocking position by rotational movement of a first component of the second locking device relative to a second component of the second locking device about a rotational axis oriented parallel to a longitudinal axis of the second ejection device; and a synchronizing device for synchronizing the first locking device and the second locking device of the first ejection device and the second ejection device, respectively, the synchronizing device including:

two synchronizing coupling pieces each associated with a respective one of the first ejection device and the second ejection device, two synchronizing coupling counter pieces each associated with a respective one of the first ejection device and the second ejection device, and a synchronizing rod connecting the two synchronizing coupling counter pieces, wherein the synchronizing device is configured such that, during an ejection movement of an ejection slider of a respective one of the first ejection device and the second ejection device, a shifting movement of the synchronizing coupling piece is converted into a rotational movement of the synchronizing rod after the over-pressing, and wherein the synchronizing coupling pieces integrally form one part of the locking guide track of the respective one of the first ejection device and the second ejection device.

* * * * *